US011205410B2

(12) United States Patent
Kim et al.

(10) Patent No.: US 11,205,410 B2
(45) Date of Patent: Dec. 21, 2021

(54) ANISOTROPIC MEDIA FOR ELASTIC WAVE MODE CONVERSION, SHEAR MODE ULTRASOUND TRANSDUCER USING THE ANISOTROPIC MEDIA, SOUND INSULATING PANEL USING THE ANISOTROPIC MEDIA, FILTER FOR ELASTIC WAVE MODE CONVERSION, ULSTRASOUND TRANSDUCER USING THE FILTER, AND WAVE ENERGY DISSIPATER USING THE FILTER

(71) Applicant: SEOUL NATIONAL UNIVERSITY R&DB FOUNDATION, Seoul (KR)

(72) Inventors: Yoon-young Kim, Seoul (KR); Xiongwei Yang, Seoul (KR); Min-woo Kweun, Seoul (KR); Hyung-jin Lee, Seoul (KR)

(73) Assignee: SEOUL NATIONAL UNIVERSITY R&DB FOUNDATION

( * ) Notice: Subject to any disclaimer, the term of this patent is extended or adjusted under 35 U.S.C. 154(b) by 704 days.

(21) Appl. No.: 16/044,483

(22) Filed: Jul. 24, 2018

(65) Prior Publication Data

US 2018/0374466 A1 Dec. 27, 2018

Related U.S. Application Data

(63) Continuation-in-part of application No. PCT/KR2017/006518, filed on Jun. 21, 2017.

(30) Foreign Application Priority Data

Jul. 25, 2017 (KR) ..... 10-2017-0093842

(51) Int. Cl.

| | |
|---|---|
| ***G10K 11/04*** | (2006.01) |
| ***G10K 11/172*** | (2006.01) |
| ***G10K 11/162*** | (2006.01) |

(52) U.S. Cl.
CPC ..... *G10K 11/04* (2013.01); *G10K 11/162* (2013.01); *G10K 11/172* (2013.01)

(58) Field of Classification Search
CPC ..... G10K 11/04; G10K 11/162; G10K 11/172
See application file for complete search history.

(56) References Cited

U.S. PATENT DOCUMENTS 5,214,613 A * 5/1993 Esmersoy ..... G01V 1/282 367/31
7,221,509 B2 * 5/2007 Suzudo ..... G02B 27/283 356/365

(Continued)

FOREIGN PATENT DOCUMENTS

JP 05-256828 A 8/1993
JP 2012161763 A 8/2012

(Continued)

OTHER PUBLICATIONS

International Search Report dated Dec. 20, 2017.
Jun Hyeong Park et al., Characterization of anisotropic acoustic metamaterial slabs, Journal of Applied Physics, p. 119, 2016.

*Primary Examiner* — Jeremy A Luks
(74) *Attorney, Agent, or Firm* — LEEPI

(57) ABSTRACT

The anisotropic media has an anisotropic layer, is disposed between outer isotropic media, causes multiple mode transmission on an elastic wave having a predetermined mode incident into the anisotropic media, and has a mode-coupling stiffness constant not zero. A thickness of the anisotropic layer according to modulus of elasticity and excitation frequency satisfies Equation (2) which is a phase matching condition of elastic waves propagating along the same direction or Equation (3) which is a phase matching condition of elastic waves propagating along the opposite direction, to generate mode conversion Fabry-Pérot resonance, $$\Delta\phi = k_{ql}d - k_{qs}d = (2n+1)\pi, \quad \text{Equation (2)}$$

(Continued)

$$\Sigma\phi = k_{ql}d + k_{qs}d = (2m+1)\pi, \quad \text{Equation (3)}$$

$k_{ql}$ is wave numbers of anisotropic media with quasi-longitudinal mode.

$l_{qs}$ is wave numbers of anisotropic media with quasi-shear mode. d is a thickness of anisotropic media. n and m are integers.

20 Claims, 35 Drawing Sheets

(56) References Cited

U.S. PATENT DOCUMENTS

| | | | | |
|---|---|---|---|---|
| 7,463,329 | B2 * | 12/2008 | Ballato | G02B 5/3083 349/169 |
| 8,189,248 | B2 * | 5/2012 | Matsubara | G03F 7/70108 359/3 |
| 10,031,286 | B1 * | 7/2018 | Li | H01S 3/0632 |
| 2013/0342915 | A1 * | 12/2013 | Min | H01Q 15/0086 359/642 |

FOREIGN PATENT DOCUMENTS

| | | | |
|---|---|---|---|
| KR | 102013105358 | A | 9/2013 |
| KR | 101626093 | A | 5/2016 |
| KR | 1030160120286 | A | 9/2016 |

* cited by examiner

ANISOTROPIC MEDIA FOR ELASTIC WAVE MODE CONVERSION, SHEAR MODE ULTRASOUND TRANSDUCER USING THE ANISOTROPIC MEDIA, SOUND INSULATING PANEL USING THE ANISOTROPIC MEDIA, FILTER FOR ELASTIC WAVE MODE CONVERSION, ULSTRASOUND TRANSDUCER USING THE FILTER, AND WAVE ENERGY DISSIPATER USING THE FILTER

BACKGROUND

1. Field of Disclosure

The present disclosure of invention relates to an anisotropic media for elastic wave mode conversion, a shear mode ultrasound transducer using the anisotropic media, and a sound insulating panel using the anisotropic media, and more specifically the present disclosure of invention relates to an anisotropic media for elastic wave mode conversion, a shear mode ultrasound transducer using the anisotropic media, and a sound insulating panel using the anisotropic media, capable of converting an elastic wave mode to be used for an industrial or medical ultrasonic wave, for decreasing a noise or a vibration, or for seismic wave related technologies.

In addition, the present disclosure of invention relates to a filter for elastic wave mode conversion, a ultrasound transducer using the filter, and a wave energy dissipater using the filter, and more specifically the present disclosure of invention relates to a filter for elastic wave mode conversion, a ultrasound transducer using the filter, and a wave energy dissipater using the filter, capable of converting an elastic wave mode to be used for an industrial or medical ultrasonic wave, for decreasing a noise or a vibration, or for seismic wave related technologies.

2. Description of Related Technology

Fabry-Pérot interferometer using Fabry-Pérot resonance which only considers a single mode, is widely used in wave related technologies such as an electromagnetic wave, a sound wave, an elastic wave and so on.

When a wave passes through a monolayer or a multilayer, multiple internal reflection and wave interference occur inside of the layer. For example, in the monolayer, a single mode incident wave passes through the layer by 100% at the Fabry-Pérot resonance frequency in which a thickness of the layer is an integer of a half of a wavelength of the incident wave. In addition, in the multilayer, the resonance frequency in which the incident wave passes through the layer by 100% may exist.

In the elastic wave, different from the electromagnetic wave or the sound wave, a longitudinal(compression) wave and a transverse(shear) wave exist due to solid atomic bonding inside of media. Thus, when the elastic wave passes through or is reflected by an anisotropic layer, the longitudinal wave may be easily converted into the transverse wave and vice versa, due to elastic wave mode coupling.

However, even though the mode conversion of the wave exists, the technology or the theory exactly explaining anisotropic media transmission phenomenon related to a multimode (the longitudinal and transverse waves) has not been developed.

Further, in the medical ultrasonic wave or ultrasonic nondestructive inspection, visualization technology and treatment technology using the transverse wave have been widely developed, but excitation for the transverse wave is relatively difficult compared to the longitudinal wave using a piezoelectric element based ultrasonic exciter. Thus, the longitudinal wave is converted into the transverse wave via obliquely incident elastic wave using a wedge, to excite the transverse wave. However, in mode conversion based on Snell's critical angle, an incident angle is limited, transmission rate is relatively low, and dependence on an incident media and a transmissive media is relatively high.

Related prior arts are U.S. Pat. Nos. 4,319,490, 6,532,827 and USPN 2004/0210134.

SUMMARY

The present invention is developed to solve the above-mentioned problems of the related arts. The present invention provides an anisotropic media for elastic mode conversion capable of converting a longitudinal wave to a transverse wave and vice versa using transmodal (or mode-conversion) Fabry-Pérot resonance.

In addition, the present invention also provides a shear mode ultrasound transducer using the anisotropic media.

In addition, the present invention also provides a sound insulating panel using the anisotropic media.

In addition, the present invention also provides a filter for elastic wave mode conversion capable of converting a longitudinal wave to a transverse wave and vice versa using transmodal (or mode-conversion) resonance.

In addition, the present invention also provides a ultrasound transducer using the filter.

In addition, the present invention also provides a wave energy dissipater using the filter.

According to an example embodiment, anisotropic media has an anisotropic layer, is disposed between outer isotropic media, causes multiple mode transmission on an elastic wave having a predetermined mode incident into the anisotropic media.

Anisotropic media has a mode-coupling stiffness constant not zero.

$$\Delta\phi = k_{ql}d - k_{qs}d = (2n+1)\pi, \qquad \text{Equation (2)}$$

$k_{ql}$ is wave numbers of anisotropic media with quasi-longitudinal mode. $k_{qs}$ is wave numbers of anisotropic media with quasi-shear mode. d is a thickness of anisotropic media. n is an integer.

$$\Sigma\phi = k_{ql}d + k_{ql}d = (2m+1)\pi, \qquad \text{Equation (3)}$$

m is an integer.

A thickness of the anisotropic layer according to modulus of elasticity and excitation frequency satisfies Equation (2) which is a phase matching condition of elastic waves propagating along the same direction or Equation (3) which is a phase matching condition of elastic waves propagating along the opposite direction, to generate mode conversion Fabry-Pérot resonance, In an example, modulus of elasticity of the anisotropic media may satisfy Equation (4), when the anisotropic media satisfies Equations (2) and (3).

$$C_{11} + C_{66} = 4\rho f_{TFPR}^2 d^2 \cdot \left(\frac{1}{(m+n+1)^2} + \frac{1}{(m-n)^2}\right), \qquad \text{Equation (4)}$$

$$C_{11}C_{66} - C_{16}^2 = \left(\frac{4\rho f_{TFPR}^2 d^2}{(m+n+1)(m-n)}\right)^2,$$

$C_{11}$ may be a longitudinal (or compressive) modulus of elasticity, $C_{66}$ may be transverse (or shear) modulus of elasticity, $C_{16}$ may be a mode coupling modulus of elasticity, ρ may be a mass density of anisotropic media, and $f_{TFPR}$ may be a mode conversion Fabry-Pérot resonance frequency.

Transmissivity frequency response and reflectivity frequency response may be symmetric with respect to a mode conversion Fabry-Pérot resonance frequency, on the incident elastic wave, Equation (5)

$$f_{TFPR} = \frac{1}{\sqrt{4\rho}\cdot d}\cdot\sqrt{C_{11}+C_{66}}\cdot\left(\frac{1}{(m+n+1)^2}+\frac{1}{(m-n)^2}\right)^{-1/2} = \frac{1}{\sqrt{4\rho}\cdot d}\cdot\sqrt[4]{C_{11}C_{66}-C_{16}^2}\cdot\sqrt{(m+n+1)(m-n)},$$

such that the resonance frequency in which maximum mode conversion is generated between a longitudinal wave and a transverse wave as in Equation (5) may be predicted or selected.

In an example, $$C_{11}=C_{66} \quad \text{Equation (6)}$$

$C_{11}$ may be modulus of longitudinal elasticity of anisotropic media, and $C_{66}$ may be modulus of shear elasticity of anisotropic media.

The anisotropic media into which the elastic wave is incident may satisfy Equation (6) which is a wave polarization matching condition under the elastic wave incidence.

In an example, when the anisotropic media satisfies Equation (6), particle vibration direction of quasi-longitudinal wave and quasi-shear wave in an eigenmode may be ±45° with respect to a horizontal direction, and modulus of elasticity may satisfy Equation (7), Equation (7)

$$C_{11}=C_{66}=2\rho f_{TFPR}^2 d^2\cdot\left(\frac{1}{(m+n+1)^2}+\frac{1}{(m-n)^2}\right),$$

$$C_{16}=\pm 2\rho f_{TFPR}^2 d^2\cdot\left|\frac{1}{(m+n+1)^2}-\frac{1}{(m-n)^2}\right|.$$

Equation (8)

$$f_{TFPR} = \frac{1}{\sqrt{2\rho}\cdot d}\cdot\sqrt{C_{11}}\cdot\left(\frac{1}{(m+n+1)^2}+\frac{1}{(m-n)^2}\right)^{-1/2} = \frac{1}{\sqrt{2\rho}\cdot d}\cdot\sqrt{|C_{16}|}\cdot\left|\frac{1}{(m+n+1)^2}-\frac{1}{(m-n)^2}\right|^{-1/2},$$

Perfect mode conversion resonance frequency in which the incident longitudinal (or transverse) wave may be perfectly converted into the transverse (or longitudinal) wave to be transmitted satisfies Equation (8).

In an example, the anisotropic media may include first and second media symmetric with each other.

the first and second media, $$C_{11}^{1st}=C_{11}^{2nd},\ C_{66}^{1st}=C_{66}^{2nd},\ C_{16}^{1st}=-C_{16}^{2nd},\ \rho_{1st}=\rho_{2nd} \quad \text{Equation (9)}$$

may satisfy Equation (9).

$C_{11}^{1st}$, $C_{66}^{1st}$, $C_{16}^{1st}$ may be modulus of longitudinal elasticity, modulus of shear elasticity and mode coupling modulus of elasticity of the first media, $C_{11}^{2nd}$, $C_{66}^{2nd}$, $C_{16}^{2nd}$ may be modulus of longitudinal elasticity, modulus of shear elasticity and mode coupling modulus of elasticity of the second media, and may be mass density of the first and second media.

In an example, each of the first and second media may include repetitive first and second microstructures, to be formed as elastic metamaterial.

In an example, the anisotropic media may be formed as a slit in which an interface facing adjacent material is a single to be a single phase, or may be formed as a repetitive microstructure having a curved or dented slit shape.

In an example, the anisotropic media may be formed as a repetitive microstructure which has a phase with a plurality of interfaces, to be formed as a slit, a circular hole, a polygonal hole, a curved hole or a dented hole.

In an example, the anisotropic media may be formed as a repetitive microstructure having an inclined shape resonator.

In an example, the anisotropic media may be formed as a repetitive microstructure which has a size smaller than a wavelength of an incident wave and has a supercell having periodicity.

In an example, the anisotropic media may be formed as at least one unit cell shape of square, rectangle, parallelogram, hexagon and other polygons, having a microstructure and being periodically arranged.

In an example, the anisotropic media may be formed as a repetitive microstructure having at least two materials different from each other.

In an example, the anisotropic media may include fluid or solid.

In an example, the outer isotropic media comprise isotropic solid or isotropic fluid.

In an example, the anisotropic media may be applied to which the elastic wave is incident in perpendicular and is incident with an inclination.

In an example, the elastic wave of the present example embodiment may be applied in cases that the elastic wave is incident into a three-dimensional space, and the anisotropic media may be used as multiple mode conversion between a shear horizontal wave and a shear vertical wave.

In an example, when the anisotropic media is formed as a three-dimensional metamaterial in the three-dimensional space, the microstructure inclined with respect to the incident direction of the wave may include various kinds of rotating body, polyhedron or curved or dented rotating body or polyhedron. A unit cell having the microstructure may be various kinds of polyhedron such as regular hexahedron, rectangle, hexagon pole and so on.

According to another example embodiment, an anisotropic media for elastic wave mode conversion has an anisotropic layer, a first side of the anisotropic media is disposed at a side of outer isotropic media, a second side of the anisotropic media is a free end or a fixed end, causes multiple mode reflection on an elastic wave having a predetermined mode incident into the anisotropic media, and has a mode-coupling stiffness constant not zero.

Equation (10) which is a phase matching condition of elastic waves propagating along the same direction.

$$\Delta\phi=k_{ql}d-k_{qs}d=(n+½)\pi, \quad \text{Equation (10)}$$

$k_{ql}$ is wave numbers of anisotropic media with quasi-longitudinal mode, $k_{qs}$ is wave numbers of anisotropic media with quasi-shear mode, d is a thickness of anisotropic media, and n is an integer.

$$\Sigma\phi=k_{ql}d+k_{qs}d=(m+½)\pi, \quad \text{Equation (11)}$$

m is an integer.

A thickness of the anisotropic layer according to modulus of elasticity and excitation frequency satisfies Equation (10) which is a phase matching condition of elastic waves propagating along the same direction or Equation (11) which is a phase matching condition of elastic waves propagating along the opposite direction, to generate mode conversion Fabry-Pérot resonance.

In an example, modulus of elasticity of the anisotropic media may satisfy Equation (12), when the anisotropic media satisfies Equations (10) and (11).

$$C_{11}+C_{66}=16\rho f_{TFPR}^2 d^2\cdot\left(\frac{1}{(m+n+1)^2}+\frac{1}{(m-n)^2}\right),\quad C_{11}C_{66}-C_{16}^2=\left(\frac{16\rho f_{TFPR}^2 d^2}{(m+n+1)(m-n)}\right)^2, \qquad \text{Equation (12)}$$

$C_{11}$ may be a longitudinal (or compressive) modulus of elasticity, $C_{66}$ may be transverse (or shear) modulus of elasticity, $C_{16}$ may be a mode coupling modulus of elasticity, ρ may be a mass density of anisotropic media, and $f_{TFPR}$ may be a mode conversion Fabry-Pérot resonance frequency.

Transmissivity frequency response and reflectivity frequency response may be symmetric with respect to a mode conversion Fabry-Pérot resonance frequency, on the incident elastic wave $$f_{TFPR}=\frac{1}{4\sqrt{\rho}\cdot d}\cdot\sqrt{C_{11}+C_{66}}\cdot\left(\frac{1}{(m+n+1)^2}+\frac{1}{(m-n)^2}\right)^{-1/2}=\frac{1}{4\sqrt{\rho}\cdot d}\cdot\sqrt[4]{C_{11}C_{66}-C_{16}^2}\cdot\sqrt{(m+n+1)(m-n)}, \qquad \text{Equation (13)}$$

such that the resonance frequency in which maximum mode conversion is generated between a longitudinal wave and a transverse wave as in Equation (13) may be predicted or selected.

In an example, the anisotropic media may perform elastic wave mode conversion around the resonance frequency, with satisfying the phase matching condition and the polarization matching condition to a certain degree.

In an example, $C_{ij}$ (i, j=1, 2, 3, 4, 5, 6) may be properly selected based on the direction of the anisotropic media and an incident plane of the elastic wave with a conventional rule.

According to still another example embodiment, a shear mode ultrasound transducer includes a meta patch mode converter having the anisotropic media. A specimen is disposed beneath the meta-patch mode converter, a longitudinal wave is incident into the meta patch mode converter, and then a defect signal reflected by a defect of the specimen passes through the meta patch mode converter, to be measured.

According to still another example embodiment, a sound insulating panel includes a meta panel mode converter having the anisotropic media, and a solid media combined with both ends of the meta panel mode converter. Fluid media is combined with first and second outer sides of the solid media. A longitudinal wave which is generated from an outer sound source and passes through the fluid media combined with the first outer side of the solid media is incident into the solid media but is blocked by the fluid media combined with the second outer side of the solid media.

According to still another example embodiment, a filter for elastic wave mode conversion includes uniform anisotropic media or elastic metamaterials, non-uniform anisotropic media having composite materials which are disposed between outer isotropic media or mode non-coupling media, and have a mode-coupling stiffness constant not zero on an incident elastic wave having a predetermined mode. The filter causes multiple mode transmission, and each of at least two elastic wave eigenmodes satisfies a phase change with integer times of half of the wavelength of the phase (or π), so that the transmodal (or mode-conversion) Fabry-Pérot resonance is generated between the longitudinal wave and the transverse wave or between the longitudinal waves different from each other.

In an example, the filter may have two elastic wave eigenmodes satisfying the phase change with integer times of π ((wave number of eigenmode)*(thickness of filter)) on the incident elastic wave, when two elastic wave eigenmodes are generated and exist inside of the filter, such that the transmodal (or mode-conversion) Fabry-Pérot resonance may be generated between the longitudinal wave and the transverse wave or between the longitudinal waves different from each other.

In an example, a first mode conversion Fabry-Pérot resonance frequency $f_1$ in which maximum mode conversion is generated, may satisfy Equation (18).

$$\frac{C_L+C_S}{\rho}=4f_1^2d^2\cdot\left(\frac{1}{N_1^2}+\frac{1}{N_2^2}\right),\quad \frac{C_LC_S-C_{MC}^2}{\rho^2}=\left(\frac{4f_1^2d^2}{N_1N_2}\right)^2 \qquad \text{Equation (18)}$$

$C_L$ may be a longitudinal modulus of elasticity of the filter, $C_S$ may be a transverse modulus of elasticity of the filter, $C_{MC}$ may be a mode coupling modulus of elasticity of the filter, ρ may be a mass density of filter, d is a thickness of filter, $N_1$ may be the number of nodal points of displacement field of a first eigenmode, and $N_2$ may be the number of the nodal points of displacement field of a second eigenmode.

In an example, second and more mode conversion Fabry-Pérot resonance frequency in which maximum mode conversion is generated, may be odd times of a first mode conversion Fabry-Pérot resonance frequency.

In an example, the filter may have a longitudinal modulus of elasticity substantially same as a transverse modulus of elasticity, to perform ultra-high pure elastic wave mode conversion in which a converted elastic wave mode is only transmitted at a resonance frequency.

In an example, a first mode conversion Fabry-Pérot resonance frequency $f_1$ in which the ultra-high pure elastic wave mode is generated, may satisfy Equation (21).

$$f_1=\frac{1}{\sqrt{2}\,d}\cdot\sqrt{\frac{C_L}{\rho}}\cdot\left(\frac{1}{N_1^2}+\frac{1}{N_2^2}\right)^{-1/2}=\frac{1}{\sqrt{2}\,d}\cdot\sqrt{\frac{|C_{MC}|}{\rho}}\cdot\left|\frac{1}{N_1^2}-\frac{1}{N_2^2}\right|^{-1/2} \qquad \text{Equation (21)}$$

$C_L$ may be a longitudinal modulus of elasticity of the filter, $C_S$ may be a transverse modulus of elasticity of the filter, $C_{MC}$ may be a mode coupling modulus of elasticity of the filter, ρ may be a mass density of filter, d may be a thickness of filter, $N_1$ may be the number of nodal points of displacement field of a first eigenmode, and $N_2$ may be the number of the nodal points of displacement field of a second eigenmode.

In an example, the elastic metamaterials may include at least one microstructure which is smaller than a wavelength of the elastic wave, and may be inclined with respect to an incident direction of the elastic wave or may be asymmetric to an incident axis of the elastic wave.

In an example, the unit pattern having the microstructure may be periodically arranged to form the filter.

In an example, the microstructure may have property gradient, and a size, a shape and a direction of the microstructure are gradually changed as the unit pattern is arranged.

In an example, the microstructure may include upper and lower microstructures. The upper microstructure may be inclined with respect to an incident direction of the elastic wave or may be asymmetric to an incident axis of the elastic wave.

In an example, the microstructure may include inner media different from the outer media with respect to an interface of the microstructure.

In an example, the microstructure may be plural in parallel with each other, in perpendicular to each other, or with an inclination with each other.

In an example, at least one unit cell shape of square, rectangle, parallelogram, hexagon and other polygons may be periodically arranged in a plane to form the microstructure, and at least one unit cell shape of cube, rectangle, parallelepiped, hexagon pole and other polyhedron may be periodically arranged in a space to form the microstructure.

In an example, the filter may have at least two elastic wave eigenmodes satisfying the phase change with integer times of π ((wave number of eigenmode)*(thickness of filter)) on the incident elastic wave, when three elastic wave eigenmodes are generated and exist inside of the filter, such that the various kinds of the mode conversion Fabry-Pérot resonance may be generated among a longitudinal wave, a horizontal transverse wave and a vertical transverse wave.

In an example, to maximize mode conversion efficiency among the longitudinal wave, the horizontal transverse wave and the vertical transverse wave, at least two of a longitudinal modulus of elasticity of the filter $C_L$, a horizontal direction shear modulus of elasticity of the filter $C_{SH}$, and a vertical direction shear modulus of elasticity of the filter $C_{SV}$, may be substantially same with each other, and at least two of a longitudinal-horizontal direction shear mode-coupling modulus of elasticity of the filter $C_{L\text{-}SH}$, a longitudinal-vertical direction shear mode-coupling modulus of elasticity of the filter $C_{L\text{-}SV}$, and horizontal direction shear-vertical direction shear mode-coupling modulus of elasticity of the filter $C_{SH\text{-}SV}$, may be substantially same with each other.

In an example, an incident longitudinal wave may be converted into a vertical transverse wave or a horizontal transverse wave. An amplitude ratio and phase difference of the mode converted horizontal transverse wave and vertical transverse wave may be controlled to generate one of a linearly polarized transverse elastic wave, a circularly polarized transverse elastic wave and an elliptically polarized transverse elastic wave.

According to still another example embodiment, a ultrasound transducer includes the filter for elastic wave mode conversion which is disposed between a ultrasound generator and a specimen.

In an example, the ultrasound transducer may further include a wedge disposed between the filter and the specimen such that the filter and the specimen may be inclined with each other, to cause an impedance matching between the ultrasound generator and the specimen.

According to still another example embodiment, a wave energy dissipater includes the filter for elastic wave mode conversion which is attached to viscoelastic material or attenuation media.

In an example, the viscoelastic material may include a human soft tissue or a rubber, and the attenuation media may include a ultrasound backing material.

According to the present example embodiments, an elastic wave mode may be converted very efficiently, using the anisotropic media and the filter satisfying the condition in which the transmodal Fabry-Pérot resonance occurs.

Here, the anisotropic media and the filter may be fabricated by various kinds of structures and materials, and thus the elastic wave mode conversion may be performed variously and various kinds of combination may be performed considering the needs of fields.

In addition, the ultrasound transducer and the wave energy dissipater are performed using the filter, and thus the elastic wave mode may be converted, the longitudinal wave which is not easy to be excited conventionally may be excited more easily via the effective mode conversion, and the wave energy may be dissipated more efficiently using the mode conversion.

DETAILED DESCRIPTION

Figure 1A:
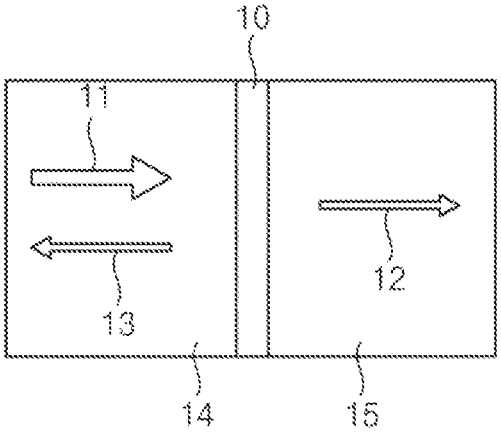
FIG. 1A is a schematic view illustrating an elastic wave passing through a media without mode conversion, conventionally

The invention is described more fully hereinafter with Reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, the same reference numerals will be used to refer to the same or like parts and any further repetitive explanation concerning the above elements will be omitted. Detailed explanation regarding prior arts will be omitted not to increase uncertainty of the present example embodiments of the present invention.

Hereinafter, the embodiments of the present invention will be described in detail with reference to the accompanied drawings.

An anisotropic media for elastic wave mode conversion according to an example embodiment of the present invention, a shear mode ultrasound transducer using the anisotropic media, and a sound insulating panel using the anisotropic media, are explained first.

Figure 1B:
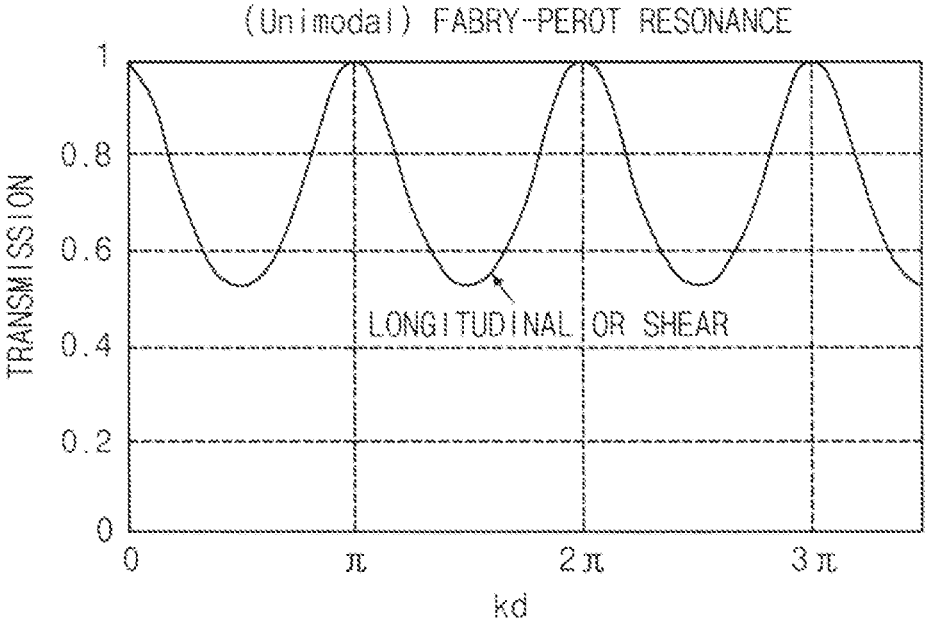
FIG. 1B is a graph showing Fabry-Pérot resonance with a single mode of FIG. 1A.

FIG. 1A is a schematic view illustrating an elastic wave passing through a media without mode conversion, conventionally and FIG. 1B is a graph showing Fabry-Pérot resonance with a single mode of FIG. 1A.

Referring to FIG. 1A, conventionally, when an elastic wave 11 is incident parallel with a principal axis of an isotropic layer or an anisotropic layer, a transmissive wave 12 and a reflective wave 13 are generated, since mode coupling between a longitudinal wave and a transverse wave does not occur in the layer.

Hereinafter, outer media 14 and 15 covering the layer 10 are considered as isotropic, and the outer media 14 and 15 and the layer 10 are considered as a solid material, for convenience of explanation.

Alternatively, the outer media may not be limited to the solid material, and may be a fluid material, and the outer media disposed at both sides of the layer may be different from each other.

In addition, in the drawings, for convenience of explanation, the explanation or the drawings for the outer media is omitted.

In addition, when Fabry-Pérot resonance occurs in a single mode at the layer without a mode-coupling, as illustrated in FIG. 1B, the transmissivity in the single mode may be 100%. Here, in the single layer 10, Fabry-Pérot resonance conditions, in which a thickness of the layer is integer times of half of the wavelength of the incident wave, satisfy Equation (1).

$$kd=n\pi \qquad \text{Equation (1)}$$

Here, k is a wave number for the single mode inside of the layer 10, d is a thickness of the layer, n is a positive number.

Figure 2A:
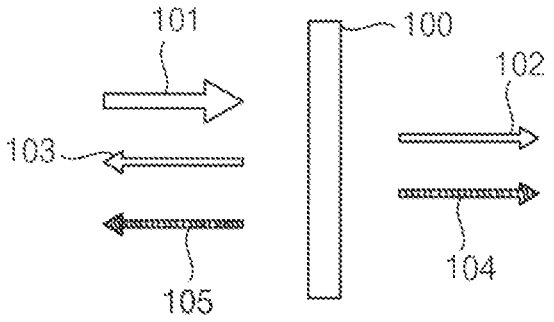
FIG. 2A is a schematic view illustrating an elastic wave passing through an anisotropic media according to an example embodiment of the present invention.
Figure 2B:
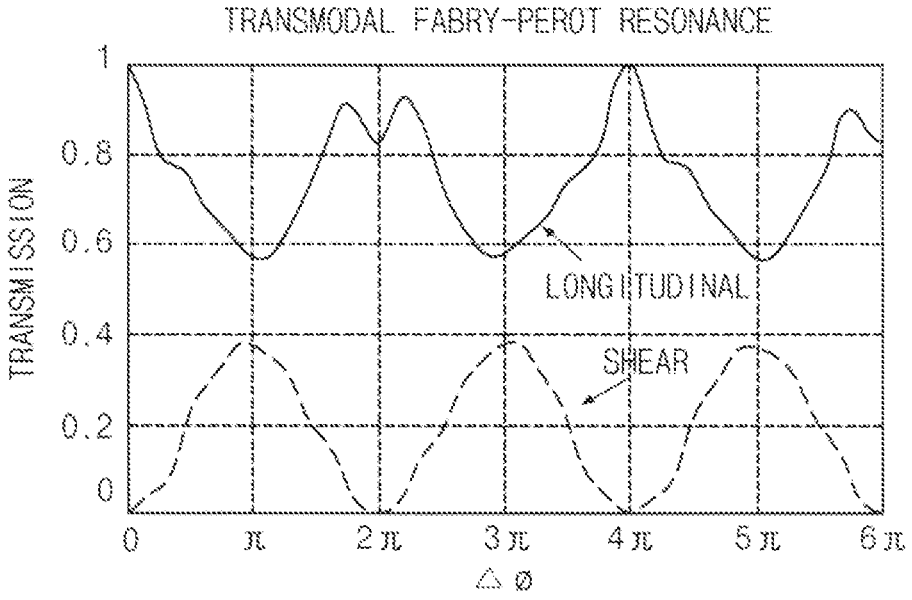
FIG. 2B is a graph showing the transmodal (or mode conversion) Fabry-Pérot resonance due to the anisotropic media of FIG. 2A.

FIG. 2A is a schematic view illustrating an elastic wave passing through an anisotropic media according to an example embodiment of the present invention, and FIG. 2B is a graph showing Fabry-Pérot resonance due to the anisotropic media of FIG. 2A.

Referring to FIG. 2A, the anisotropic media 100 according to the present example embodiment is an anisotropic layer which is transmissive, and has a mode-coupling stiffness constant not zero.

Thus, as illustrated in the figure, when the elastic wave 101 is incident into the anisotropic media 100, a transformed mode, in addition to a transmissive wave 102 and a reflective wave 103, is generated. For example, when a longitudinal wave is incident, a transverse transmissive wave 104 and a transverse reflective wave 105 are generated together.

Here, the conditions in which so called 'transmodal Fabry-Pérot resonance' occurs exist, and the conditions are different from the conventional single mode resonance condition as expressed in Equation (1) and are variously expressed. A transmodal transmissivity may be maximized at the conditions in which the transmodal Fabry-Pérot resonance occurs.

In the mode conversion using a weakly mode-coupled anisotropic layer having a mode-coupling stiffness constant is relatively small compared to other stiffness constants, the transmissivity is expressed as illustrated in FIG. 2B, when the longitudinal wave is incident into the layer.

For example, referring to FIG. 2B, the longitudinal wave which is an incident wave 101 is partially converted into the transverse wave to be generated as the transmissive wave 104, and a maximum conversion transmissivity occurs when the wave modes of the anisotropic layer 100 have predetermined phase difference. As one-dimensional vertical incidence in FIG. 2A, the maximum conversion transmissivity from the longitudinal wave to the transverse wave (or vice versa) may occur around the resonance frequency satisfying the phase matching condition of Equation (2).

Thus, using the anisotropic media 100 satisfying Equation (2), the transmodal (or mode conversion) Fabry-Pérot resonance is generated.

$$\Delta\phi=k_{ql}d-k_{qs}d=(2n+1)\pi, \qquad \text{Equation (2)}$$

Here, $k_{ql}$ is wave numbers of anisotropic media 100 with quasi-longitudinal mode, $k_{qs}$ is wave numbers of anisotropic media 100 with quasi-shear mode, d is a thickness of anisotropic media 100, and n is an integer.

The conditions for the transmodal (or mode conversion) Fabry-Pérot resonance having the weakly mode-coupling are considered as co-directional phase-matching conditions, contra-directional phase-matching conditions are exist inside of the anisotropic layer 100, and are defined as Equation (3) at the one dimensional vertical incidence as in FIG. 2A.

$$\Sigma\phi=k_{ql}d+k_{qs}d=(2m+1)\pi, \qquad \text{Equation (3)}$$

Here, m is an integer.

Figure 3A:
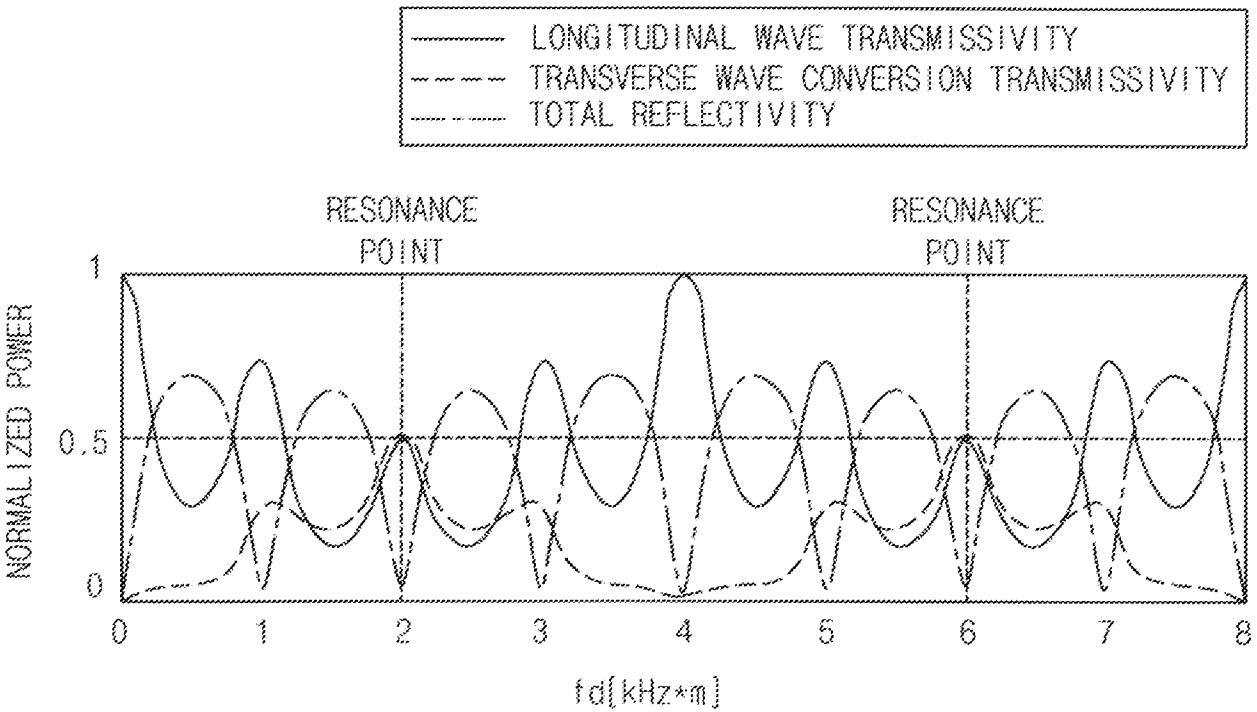
FIG. 3A is a graph showing transmissivity and reflectivity in cases that phase matching conditions are satisfied when a longitudinal wave is incident into the anisotropic media.
Figure 3B:
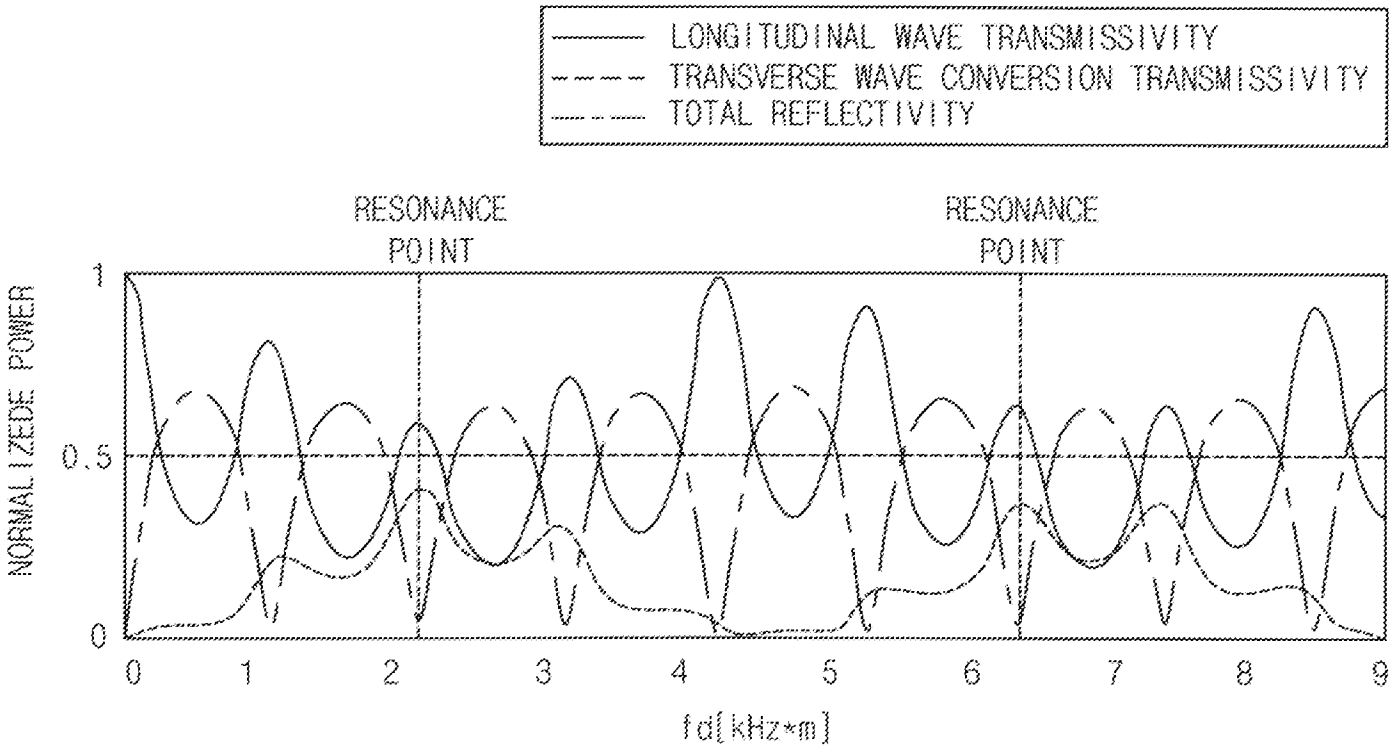
FIG. 3B is a graph showing transmissivity and reflectivity in cases that the phase matching conditions are not satisfied when the longitudinal wave is incident into the anisotropic media (f: frequency, d: thickness of anisotropic media)

FIG. 3A is a graph showing transmissivity and reflectivity in cases that the phase matching conditions are satisfied when a longitudinal wave is incident into the anisotropic media, and FIG. 3B is a graph showing transmissivity and reflectivity in cases that the phase matching conditions are not satisfied when the longitudinal wave is incident into the anisotropic media (f: frequency, d: thickness of anisotropic media).

FIG. 3A shows the transmissivity and the reflectivity when the incident elastic wave passes through the anisotropic layer 100 with satisfying Equation (2) and Equation (3) of the transmodal Fabry-Pérot resonance, and FIG. 3B shows the transmissivity and the reflectivity without exactly satisfying Equation (2) and Equation (3).

As illustrated in the figure, when a modulus of elasticity of the anisotropic media 100 satisfies the above-mentioned two phase matching conditions, Equation (4) is also satisfied.

$$C_{11}+C_{66}=4\rho f_{TFPR}^2 d^2\cdot\left(\frac{1}{(m+n+1)^2}+\frac{1}{(m-n)^2}\right), \qquad \text{Equation (4)}$$

$$C_{11}C_{66}-C_{16}^2=\left(\frac{4\rho f_{TFPR}^2 d^2}{(m+n+1)(m-n)}\right)^2,$$

Here, $C_{11}$ is a longitudinal (or compressive) modulus of elasticity, $C_{66}$ is transverse (or shear) modulus of elasticity, $C_{16}$ is a mode coupling modulus of elasticity, ρ is a mass density of anisotropic media, and $f_{TFPR}$ is a mode conversion (or transmodal) Fabry-Pérot resonance frequency.

Here, the transmissivity frequency response and the reflectivity frequency response are symmetric with respect to the resonance frequency, for the elastic wave incident for the anisotropic media 100. Thus, with the above-mentioned two phase matching conditions, the resonance frequency at which the mode conversion is maximized, may be predicted as Equation (5).

$$f_{TFPR}=\frac{1}{\sqrt{4\rho}\cdot d}\cdot\sqrt{C_{11}+C_{66}}\cdot\left(\frac{1}{(m+n+1)^2}+\frac{1}{(m-n)^2}\right)^{-1/2} \qquad \text{Equation (5}$$

$$=\frac{1}{\sqrt{4\rho}\cdot d}\cdot\sqrt[4]{C_{11}C_{66}-C_{16}^2}\cdot\sqrt{(m+n+1)(m-n)},$$

For the anisotropic layer 100 having the modulus of elasticity without satisfying the above-mentioned phase matching conditions, the transmissivity frequency response and the reflectivity frequency response are asymmetric with respect to the resonance frequency. Thus, using Equation (2) which is the co-directional phase-matching conditions, the resonance frequency at which the mode conversion is maximized may be roughly predicted.

Figure 4A:
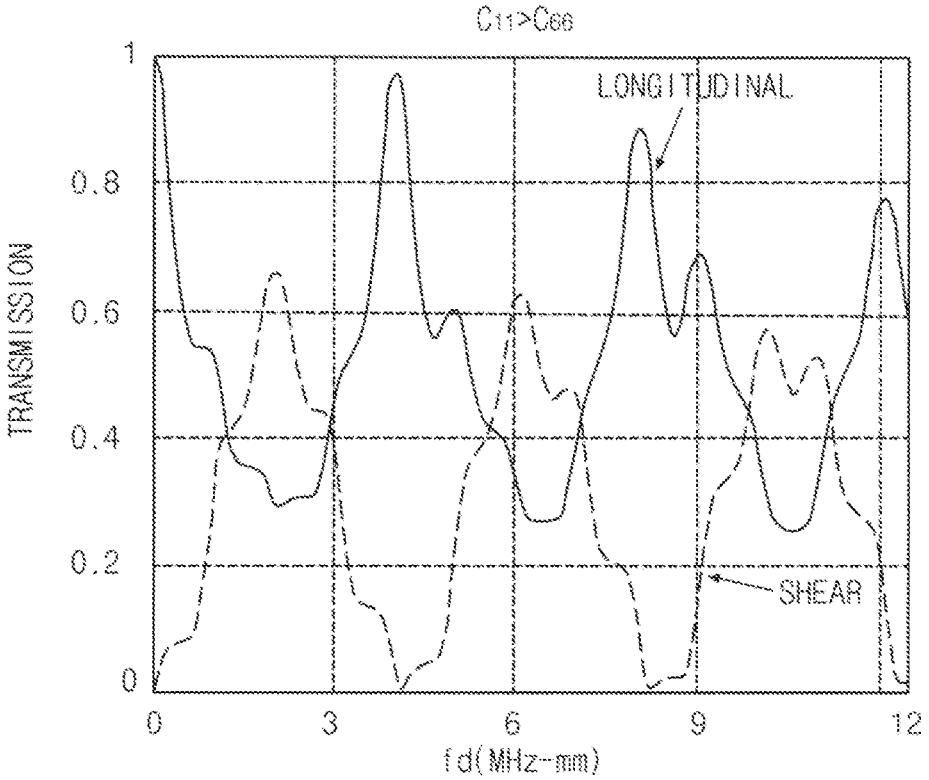
FIGS. 4A to 4C are graphs showing an effect of wave polarization matching condition inside of the anisotropic media 100 on a mode conversion ratio.
Figure 4B:
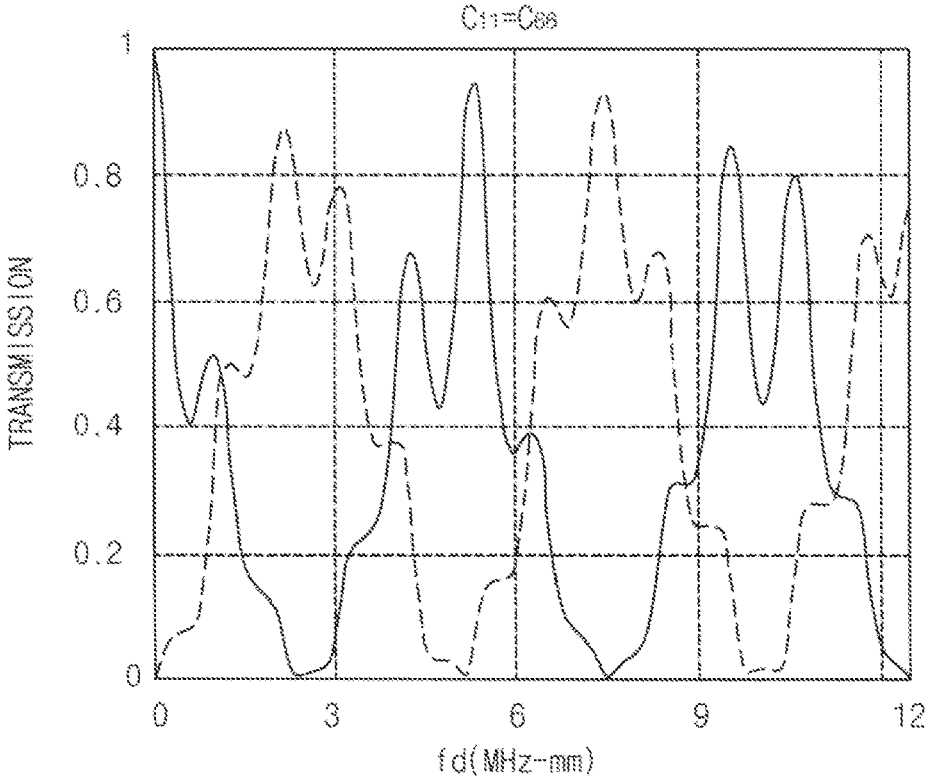
Figure 4C:
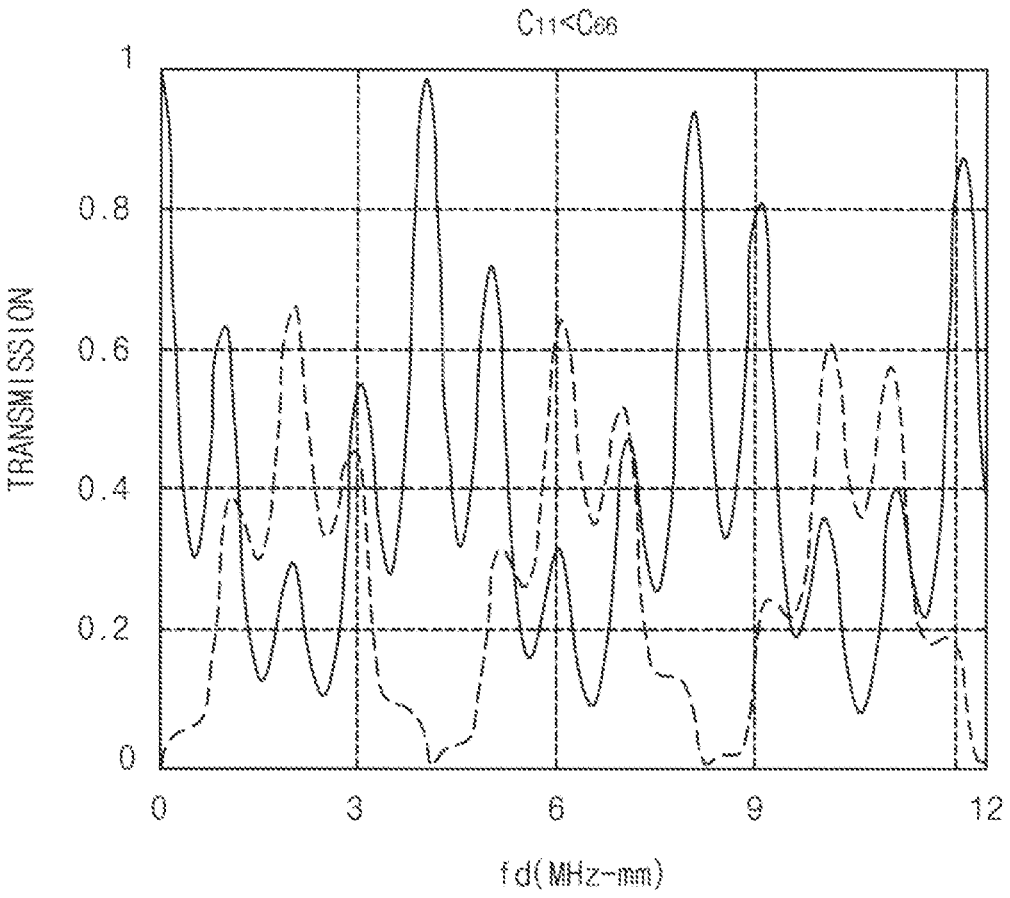

FIGS. 4A to 4C are graphs showing an effect of wave polarization matching condition inside of the anisotropic media 100 on a mode conversion (transmodal) ratio.

In the transmodal Fabry-Pérot resonance conditions as explained above, in addition to the phase matching conditions as expressed Equation (2) and Equation (3), polarization matching conditions exist inside of the anisotropic layer 100 and are expressed as Equation (6) when the elastic wave 101 is vertically incident into the anisotropic media 100.

$$C_{11}=C_{66} \qquad \text{Equation (6)}$$

Here, $C_{11}$ is modulus of longitudinal elasticity of anisotropic media, and $C_{66}$ is modulus of shear elasticity of anisotropic media.

In the anisotropic media 100 satisfying the polarization matching conditions of Equation (6), a particle vibration direction of quasi-longitudinal wave and quasi-shear wave in an eigenmode is ±45° with respect to a horizontal direction.

Referring to FIGS. 4A to 4C, as for the one dimensional vertical incident into the anisotropic media 100, the transmissivity frequency response at the anisotropic media 100 satisfying the polarization matching conditions of Equation (6) is illustrated in FIG. 4B. Thus, the anisotropic media 100 may be mode converted with high conversion rate and high purity, around the mode conversion (transmodal) resonance point.

The polarization matching conditions of Equation (6) may be applied independent of the above-mentioned two phase matching conditions, and in FIGS. 4A to 4C, the anisotropic media do not satisfy the phase matching conditions. Thus, the frequency response of the longitudinal wave transmissivity and the frequency response of the transverse wave transmissivity are not symmetric with respect to the mode conversion resonance point.

Figure 5A:
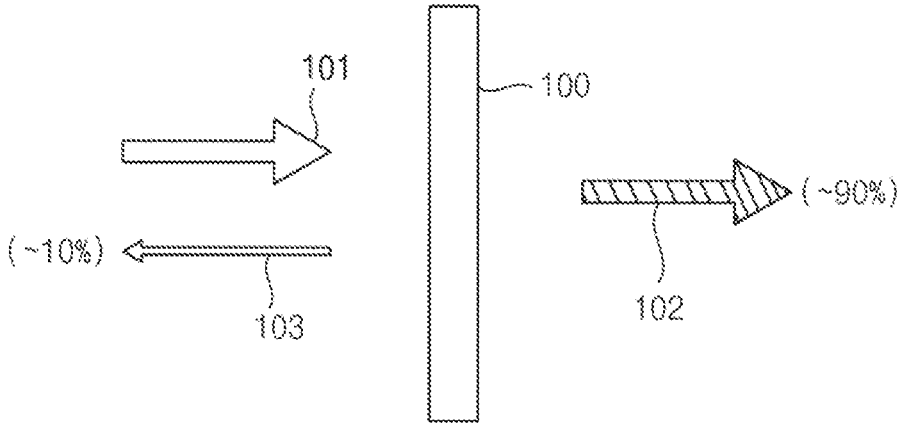
FIG. 5A is a schematic view illustrating an elastic wave passing through an anisotropic media when the transmodal (or mode conversion) Fabry-Pérot resonance occurs perfectly.
Figure 5B:
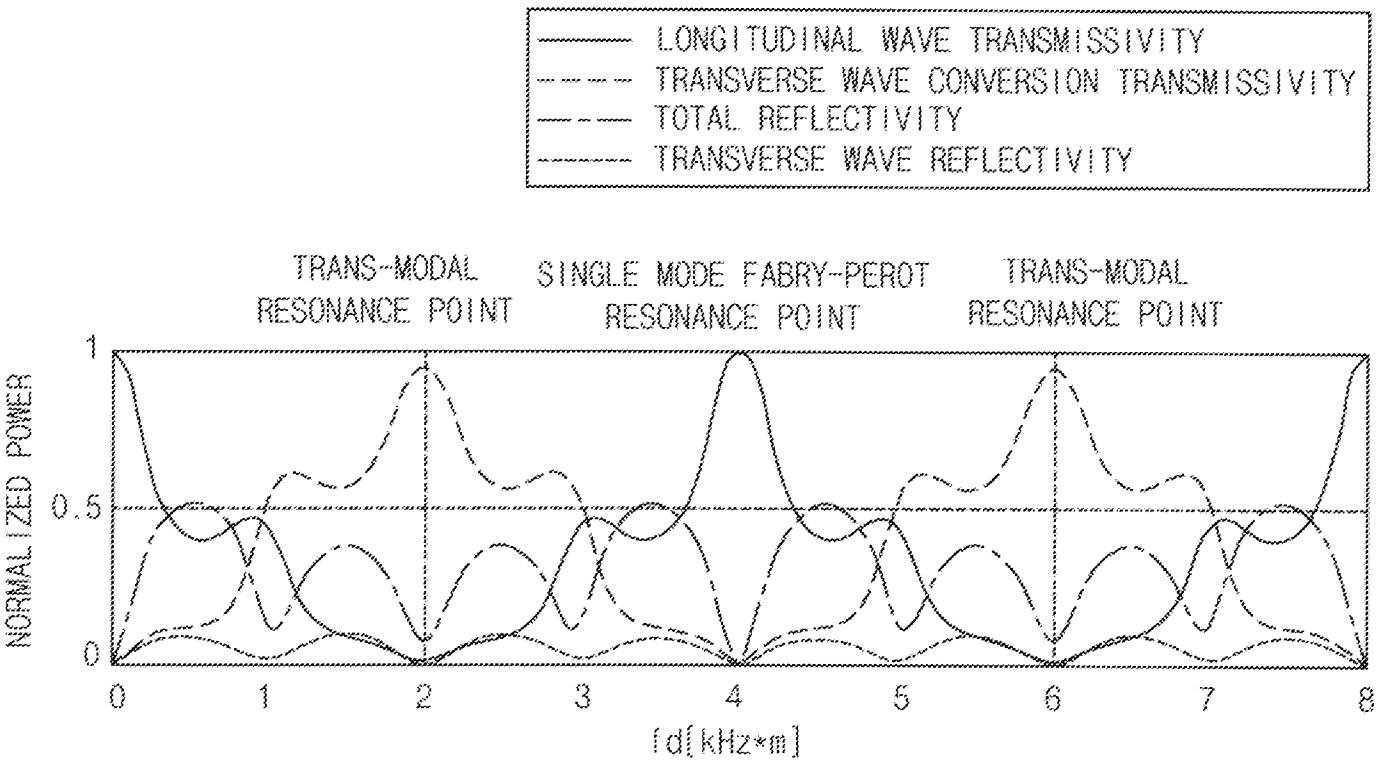
FIG. 5B is a graph showing an example of a frequency response when the mode conversion Fabry-Pérot resonance occurs perfectly due to the anisotropic media of FIG. 5A.

FIG. 5A is a schematic view illustrating an elastic wave passing through an anisotropic media when the mode conversion Fabry-Pérot resonance occurs perfectly, and FIG. 5B is a graph showing an example of a frequency response when the Fabry-Pérot resonance occurs perfectly due to the anisotropic media of FIG. 5A.

Referring to FIG. 5A, the modulus of elasticity of the anisotropic media 100 according to the present example embodiment satisfies Equation (7), when the phase matching conditions and the polarization matching conditions of Equation (2), Equation (3) and Equation (6) are fully satisfied.

In addition, in the layer having the anisotropic media, the perfect transmodal Fabry-Pérot resonance occurs at the resonance frequency satisfying Equation (8).

$$C_{11}=C_{66}=2\rho f_{TFPR}^2 d^2\cdot\left(\frac{1}{(m+n+1)^2}+\frac{1}{(m-n)^2}\right),\quad C_{16}=\pm 2\rho f_{TFPR}^2 d^2\cdot\left|\frac{1}{(m+n+1)^2}-\frac{1}{(m-n)^2}\right|. \qquad \text{Equation (7)}$$

$$f_{TFPR}=\frac{1}{\sqrt{2\rho}\cdot d}\cdot\sqrt{C_{11}}\cdot\left(\frac{1}{(m+n+1)^2}+\frac{1}{(m-n)^2}\right)^{-1/2}=\frac{1}{\sqrt{2\rho}\cdot d}\cdot\sqrt{|C_{16}|}\cdot\left|\frac{1}{(m+n+1)^2}-\frac{1}{(m-n)^2}\right|^{-1/2}, \qquad \text{Equation (8)}$$

Thus, when the longitudinal wave is incident as the incident wave 101, the transverse wave 102 is transmissive. When the outer media is an isotropic metal media, about more than 90% mode conversion (transmodal) transmissivity occurs. Here, the wave mode of the incident wave 101 may be the longitudinal wave and the transverse wave.

The reflective wave, without the mode conversion, is reflected as the longitudinal wave 103, and when the outer media is the isotropic metal media, less than 10% non-transmodal transmissivity occurs.

Accordingly, when the perfect mode conversion (transmodal) resonance occurs, perfect mode isolation occurs in which the longitudinal wave 101 and 103 is isolated with the transverse wave 102 with respect to the anisotropic media 100.

Referring to FIG. 5B, the transmissivity and reflectivity frequency response of the anisotropic media 100 are illustrated when the perfect transmodal Fabry-Pérot resonance occurs. As illustrated in the figure, the single mode Fabry-Pérot resonance (100% non-transmodal transmissivity) perfectly occurs at the center of the mode conversion resonance point.

Figure 6A:
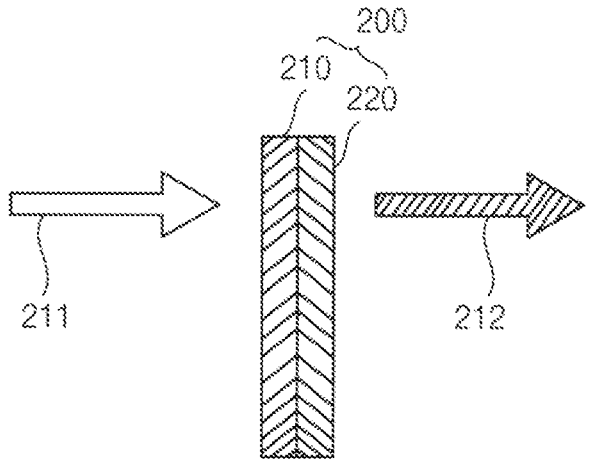
FIG. 6A is a schematic view illustrating an elastic wave passing through an anisotropic media having a dual layer according to another example embodiment of the present invention.
Figure 6B:
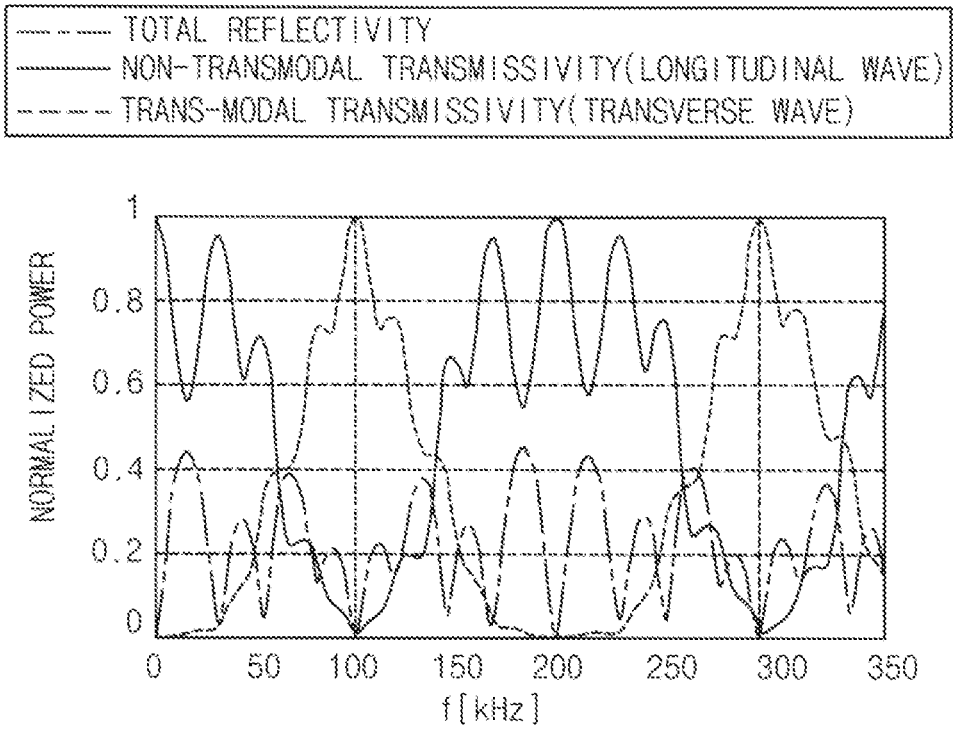
FIG. 6B is a graph showing transmitting and reflecting frequency response of the elastic wave due to the anisotropic media of FIG. 6A.

FIG. 6A is a schematic view illustrating an elastic wave passing through an anisotropic media having a dual layer according to another example embodiment of the present invention, and FIG. 6B is a graph showing transmitting and reflecting frequency response of the elastic wave due to the anisotropic media of FIG. 6A.

The reflection of the incident wave may be minimized, and the elastic wave transmodal transmissivity may be maximized or minimized, using the dual layer anisotropic media 200, which is not performed by the single layer anisotropic media 100.

As illustrated in FIG. 6A, the anisotropic media 200 includes a first media 210 and a second media 220, and microstructures of the elastic meta material included in the first and second media 210 and 220 are mirror symmetric with each other. Thus, the reflection of the incident wave is minimized and the elastic wave transmodal transmissivity is maximized. Here, the elastic wave transmodal transmissivity may be more than 99%.

Here, when the single mode elastic wave 211 is one-dimensionally and vertically incident into the anisotropic media 200, mirror symmetric conditions of the microstructure is expressed as Equation (9).

$$C_{11}^{1st}=C_{11}^{2nd},\ C_{66}^{1st}=C_{66}^{2nd},\ C_{16}^{1st}=-C_{16}^{2nd},\ \rho_{1st}=\rho_{2nd} \qquad \text{Equation (9)}$$

Here, $C_{11}^{1st}$, $C_{66}^{1st}$, $C_{16}^{1st}$ are modulus of longitudinal elasticity, modulus of shear elasticity and mode coupling modulus of elasticity of the first media 210.

$C_{11}^{2nd}$, $C_{66}^{2nd}$, $C_{16}^{2nd}$ are modulus of longitudinal elasticity, modulus of shear elasticity and mode coupling modulus of elasticity of the second media 220.

$\rho_{1st}$, $\rho_{2nd}$ are mass density of the first and second media 210 and 220.

Figure 7A:
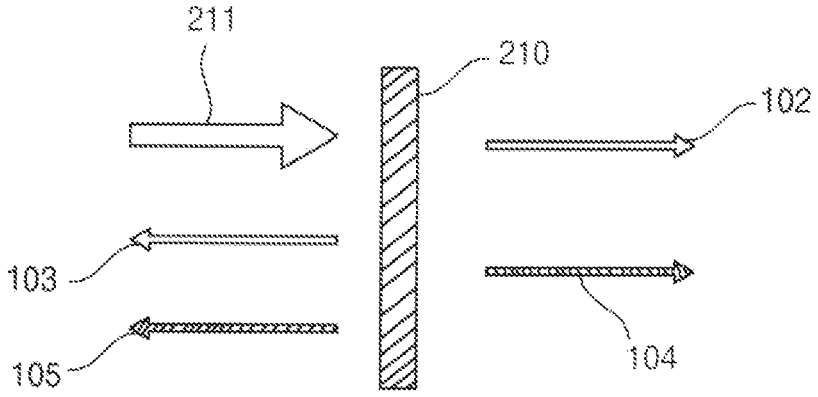
FIG. 7A is a schematic view illustrating an elastic wave passing through a first media of the anisotropic media having the dual layer of FIG. 6A.
Figure 7B:
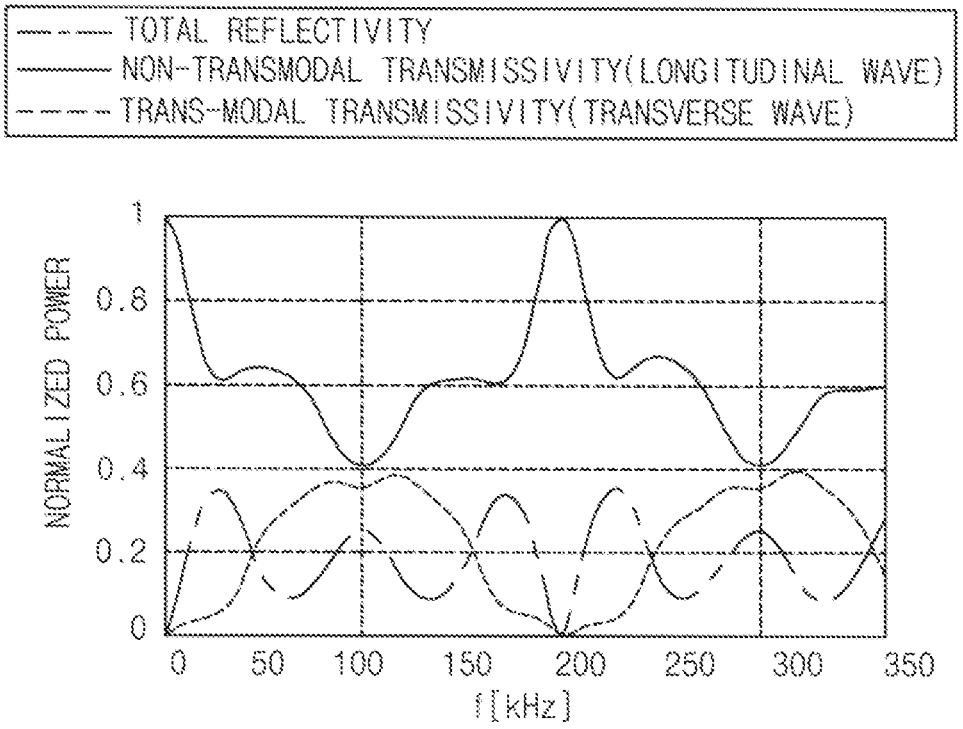
FIG. 7B is a graph showing transmitting and reflecting frequency response of the elastic wave due to the first media of FIG. 7A.

FIG. 7A is a schematic view illustrating an elastic wave passing through a first media of the anisotropic media having the dual layer of FIG. 6A, and FIG. 7B is a graph showing transmitting and reflecting frequency response of the elastic wave due to the first media of FIG. 7A.

As illustrated in FIGS. 7A and 7B, when the elastic wave 211 is incident into the first media 210, about 40% of the transmissive wave 102 and 104 is mode-converted (longitudinal wave is converted to transverse wave, and vice versa), and about 40% of the reflective wave 103 and 105 is mode-converted.

Accordingly, using the dual layer anisotropic media 200 having the overlapped single layers at which the mode conversion occur, the reflectivity is minimized compared to the single layer, and almost perfect trans-modal transmissivity may be performed.

Figure 8:
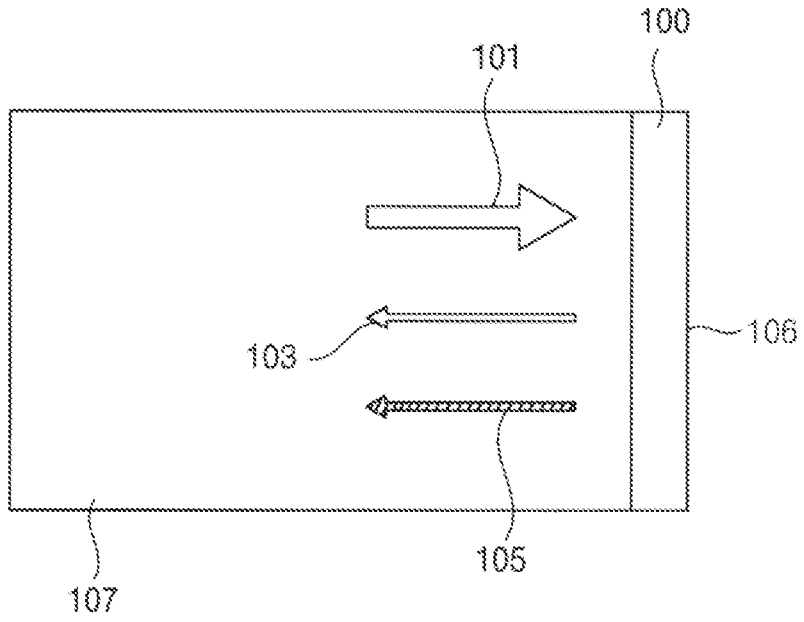
FIG. 8 is a schematic view illustrating an elastic wave passing through an anisotropic media in which one interface of the anisotropic media is a free end or a fixed end according to still another example embodiment of the present invention.
Figure 9A:
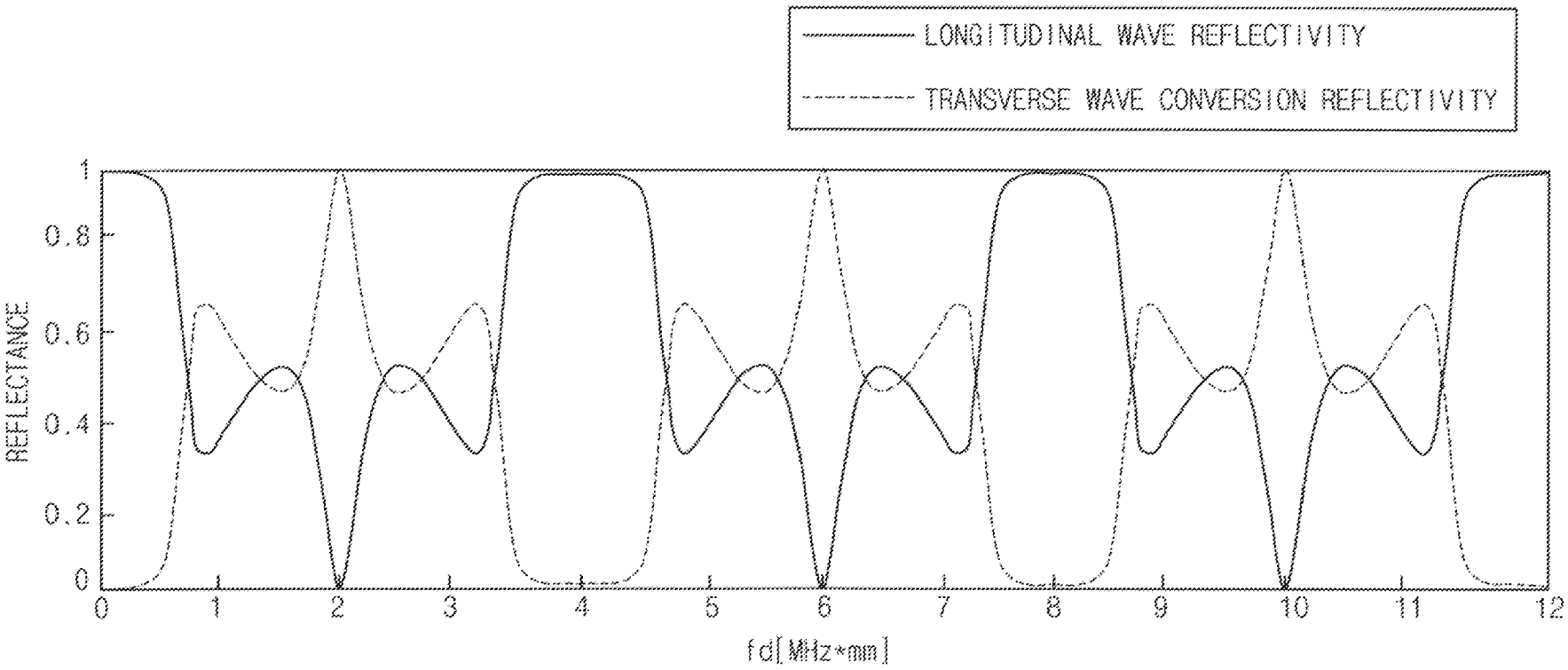
FIG. 9A is a graph showing a reflectivity frequency response when free end interface conditions are applied to an interface opposite to the face to which the elastic wave is incident.
Figure 9B:
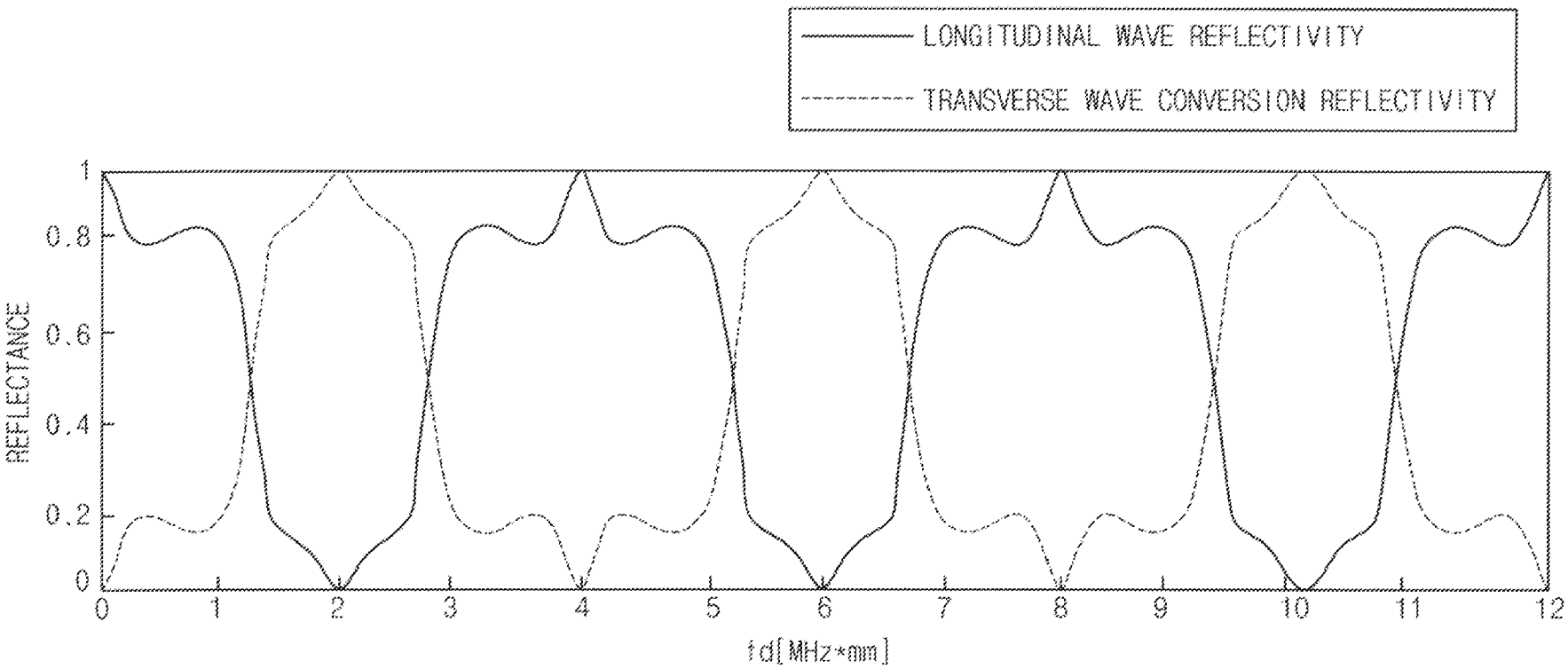
FIG. 9B is a graph showing the reflectivity frequency response when fixed end interface conditions are applied to the interface of FIG. 9A.

FIG. 8 is a schematic view illustrating an elastic wave passing through an anisotropic media in which one interface of the anisotropic media is a free end or a fixed end according to still another example embodiment of the present invention. FIG. 9A is a graph showing a reflectivity frequency response when free end interface conditions are applied to an interface opposite to the face to which the elastic wave is incident, and FIG. 9B is a graph showing the reflectivity frequency response when fixed end interface conditions are applied to the interface of FIG. 9A.

Referring to FIG. 8, in the present example embodiment, when a first interface 106 of the anisotropic media 100 is a free end or a fixed end, the anisotropic media 100 may be used as reflection type elastic wave mode converters.

The free end condition may be approximated to the case that the outer media 15 through which the elastic wave passes is a material like a gas as in FIG. 1A, and the fixed end condition may be approximated to the case that the outer media 15 is a solid material having relatively large mass density and stiffness.

When the modulus of elasticity of the anisotropic media and the thickness of the anisotropic media according to the excited frequency satisfy Equation (10) which is reflection type co-directional phase-matching conditions and Equation (11) which is reflection type contra-directional phase-matching conditions, the reflection-type transmodal Fabry-Pérot resonance occurs, such that the incident longitudinal wave (transverse wave) is converted to the transverse wave (longitudinal wave) in maximum, as for the property of the outer media 107. For example, Poisson's ratio may be the property, when the outer media is the isotropic media.

$$\Delta\phi \equiv k_{qt}d - k_{qs}d = (n+1/2)\pi, \quad \text{Equation (10)}$$

$$\Sigma\phi \equiv k_{qt}d + k_{qs}d = (m+1/2)\pi, \quad \text{Equation (11)}$$

Here, the modulus of elasticity for the reflection type anisotropic media is expressed as Equation (12).

$$C_{11} + C_{66} = 16\rho f_{TFPR}^2 d^2 \cdot \left(\frac{1}{(m+n+1)^2} + \frac{1}{(m-n)^2}\right), \quad \text{Equation (12)}$$

$$C_{11}C_{66} - C_{16}^2 = \left(\frac{16\rho f_{TFPR}^2 d^2}{(m+n+1)(m-n)}\right)^2,$$

In addition, the reflection type transmodal Fabry-Pérot resonance frequency at which the transmodal reflectivity is maximized is expressed as Equation (13), and thus the resonance frequency may be predicted and selected as for the property of the outer media 107, like the transmission type mode conversion.

$$f_{TFPR} = \frac{1}{4\sqrt{\rho}\cdot d}\cdot\sqrt{C_{11}+C_{66}}\cdot \left(\frac{1}{(m+n+1)^2} + \frac{1}{(m-n)^2}\right)^{-1/2} = \frac{1}{4\sqrt{\rho}\cdot d}\cdot\sqrt[4]{C_{11}C_{66}-C_{16}^2}\cdot\sqrt{(m+n+1)(m-n)}, \quad \text{Equation (13)}$$

Accordingly, when the reflection type transmodal anisotropic media perfectly or approximately satisfy the above-mentioned two reflection type phase matching conditions and the polarization matching conditions of Equation (6), the perfect Fabry-Pérot resonance occurs. Here, in the perfect Fabry-Pérot resonance, a first mode perfectly incident is converted to a second mode to be reflected, for the property of the outer media 107.

As for the reflection type transmodal anisotropic media, almost perfect mode conversion may be performed according to the property of the outer media 107, even though the polarization matching conditions of Equation (6) is approximately satisfied, compared to the transmission type transmodal anisotropic media.

FIGS. 9A and 9B illustrate the reflectivity frequency response of the anisotropic media, when the longitudinal mode is incident into the reflection type anisotropic media from the outer media 107. As illustrated in the figure, FIG. 9A illustrates the reflectivity frequency response when the free end conditions are applied to the interface 106 opposite to the interface into which the elastic wave 101 is incident, and FIG. 9B illustrates the reflectivity frequency response when the fixed end conditions are applied thereto.

Figure 10:
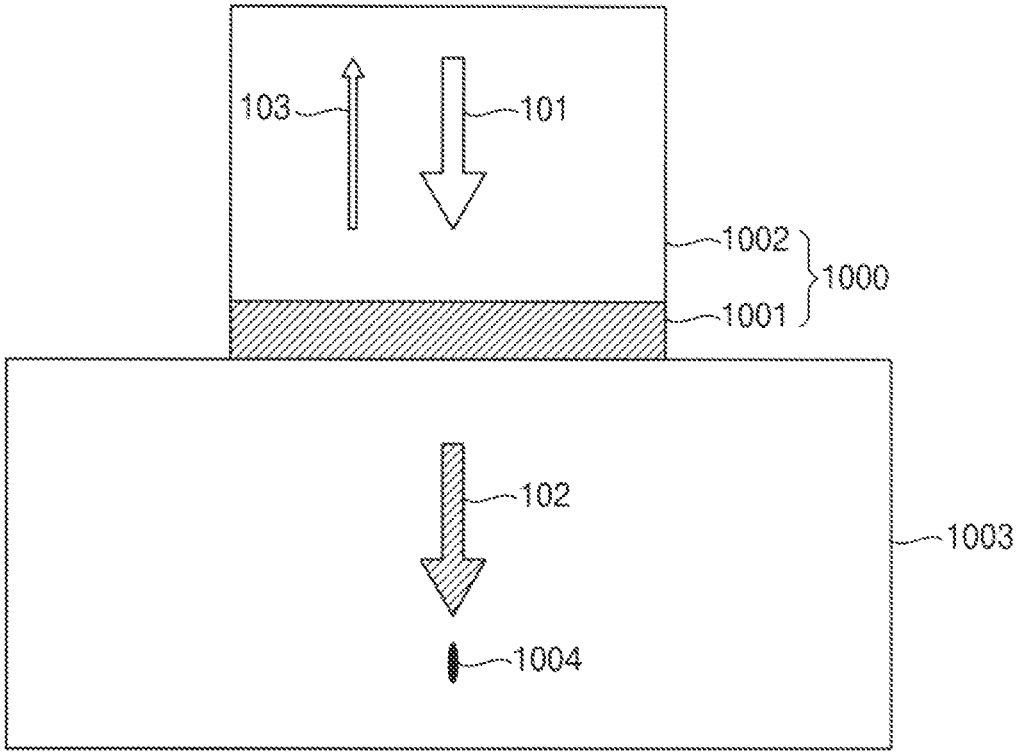
FIG. 10 is a schematic view illustrating a shear mode ultrasound transducer using the anisotropic media to generate a shear ultrasound, according to still another example embodiment of the present invention.
Figure 11:
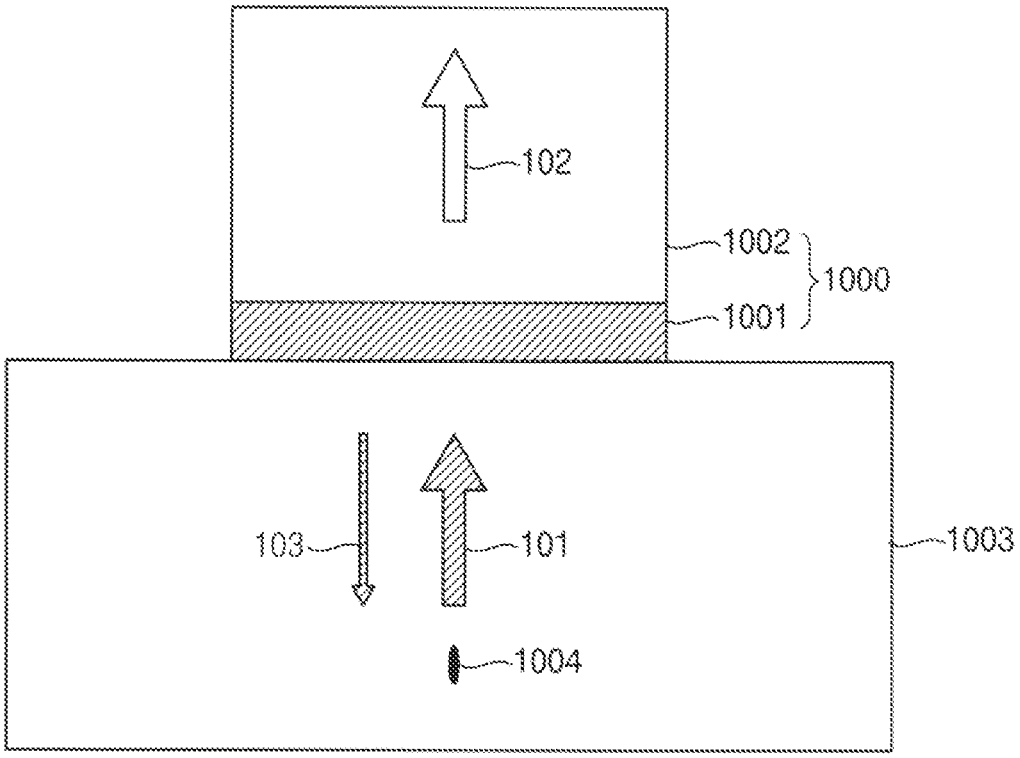
FIG. 11 is a schematic view illustrating the shear mode ultrasound transducer of FIG. 10 measuring shear ultrasound defect signal.

FIG. 10 is a schematic view illustrating a shear mode ultrasound transducer using an anisotropic media to generate a shear ultrasound, according to still another example embodiment of the present invention. FIG. 11 is a schematic view illustrating the shear mode ultrasound transducer of FIG. 10 measuring shear ultrasound defect signal.

Conventionally, the elastic wave transmodal anisotropic media 100 may be applied to develop a shear mode (or a transverse wave mode) ultrasound transducer. A shear mode ultrasound is different from the longitudinal mode ultrasound, in a particle motion direction, a phase speed, an attenuation factor and so on, and thus, defects 1004 which are not easily detected by the conventional longitudinal mode ultrasound may be detected more sensitively and more efficiently. In the conventional piezoelectric element based ultrasound transducer, the longitudinal wave is easily generated and measured, but selective excitation for the shear wave is very difficult. Thus, conventionally, using the ultrasound wedge, the longitudinal wave generated by the conventional ultrasound transducer is converted to the shear wave to be used. However, at the interface between the wedge and the transducer and the interface between the wedge and the specimen (the specimen is a metal material in industrial non-destructive inspection), reflection loss of the ultrasound energy is relatively large due to the material property difference among the transducer, the wedge and the specimen.

The anisotropic media 100 according to the previous example embodiment may be applied to a meta-patch mode converter 1001 which is attached to the conventional ultrasound transducer 1002 and is very compatible.

As illustrated in FIG. 10, the anisotropic media 100 is included in the meta-patch mode converter 1001, and then is applied to the shear mode ultrasound transducer 1000, to generate a high efficiency shear wave 102.

Very small amount of the incident longitudinal wave 101 is reflected to be the reflective wave 103, and the remaining incident longitudinal wave 101 passes through the meta-patch mode converter 1001 to be generated as the high efficiency shear wave 102. Thus, the structural defect 1004 may be detected or measured more easily.

In addition, as illustrated in FIG. 11, when the anisotropic media 100 is performed as the meta-patch mode converter 1001, the shear wave 101 reflected by the structural defect 1004 of the specimen 1003 is converted to be the measurable longitudinal wave 102, and thus the converted longitudinal wave 102 having high signal intensity may be detected or measured more easily.

Accordingly, the anisotropic media 100 may be applied to the sensor type shear mode ultrasound transducer 1000 measuring the longitudinal wave 102 which is converted with high signal intensity.

Figure 12:
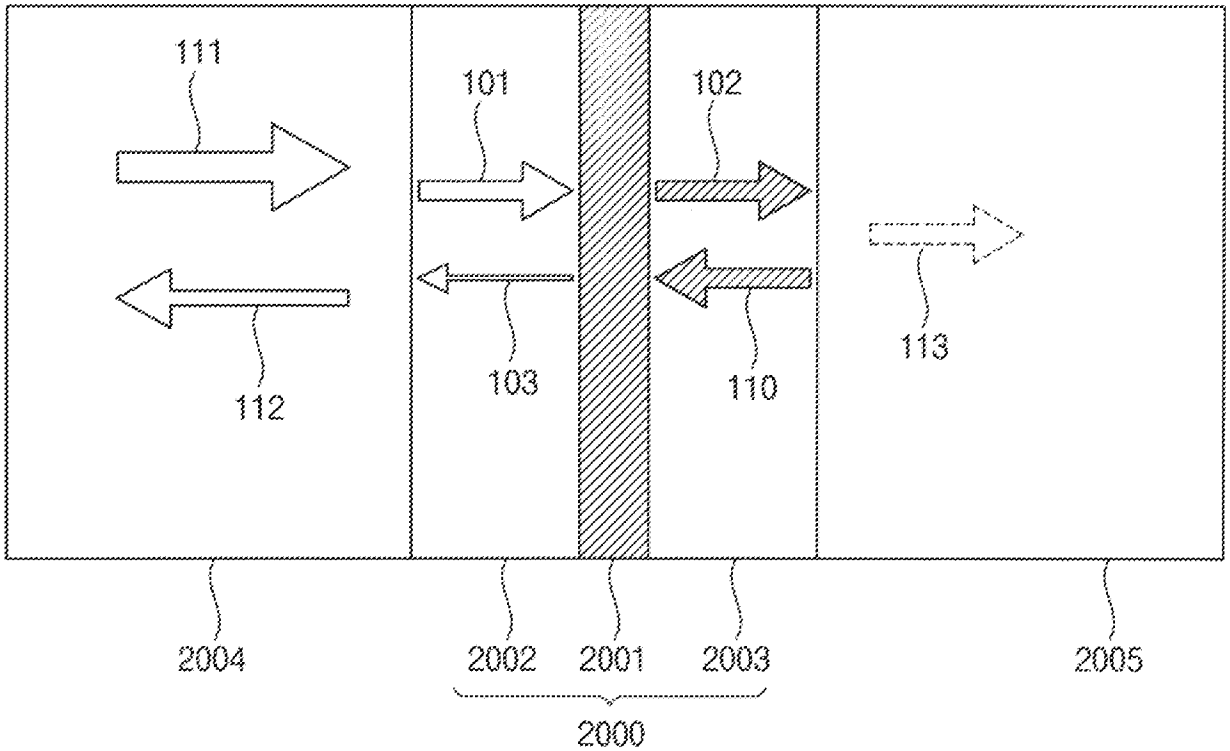
FIG. 12 is a schematic view illustrating a sound insulating panel using the anisotropic media, according to still another example embodiment of the present invention.

FIG. 12 is a schematic view illustrating a sound insulating panel using an anisotropic media, according to still another example embodiment of the present invention.

The elastic wave trans-modal anisotropic media 100 may be applied to the transmodal Fabry-Pérot resonance (TFPR) based sound insulating panel. When the wave energy is transmitted from the solid media to the fluid media, in the vertical incident, the shear wave (the transverse wave) is not transmitted to the fluid media having no shear modulus and is blocked inside the solid media panel.

FIG. 12 shows the sound insulating panel 2000 in which the anisotropic media 100 is used as the meta-panel mode converter 2001, and illustrates that the sound wave blocking function of the sound insulating panel 2000 based on the transmodal Fabry-Pérot resonance (TFPR).

Referring to FIG. 12, the sound wave 111 incident into the sound insulating panel 2000 from an outer fluid media 2004 partially becomes a longitudinal mode elastic wave inside of the solid media 2002, firstly, and then passes through the meta-panel mode converter 2001 to be converted to the shear wave 102 together with small amount of the reflective wave 103 with high efficiency.

Here, the converted shear wave 102 does not pass through the fluid media 2005 having not shear stiffness, and is reflected in the interface to be blocked inside of the solid insulating panel as the shear wave 110. Thus, the sound wave 113 toward the fluid media 2005 may be effectively blocked or insulated.

Here, the thickness of the layer of the solid media 2002 and 2003 relative to the meta-panel mode converter 2001 forming the transmodal resonance insulating panel 2000, may be properly changed.

Figure 13:
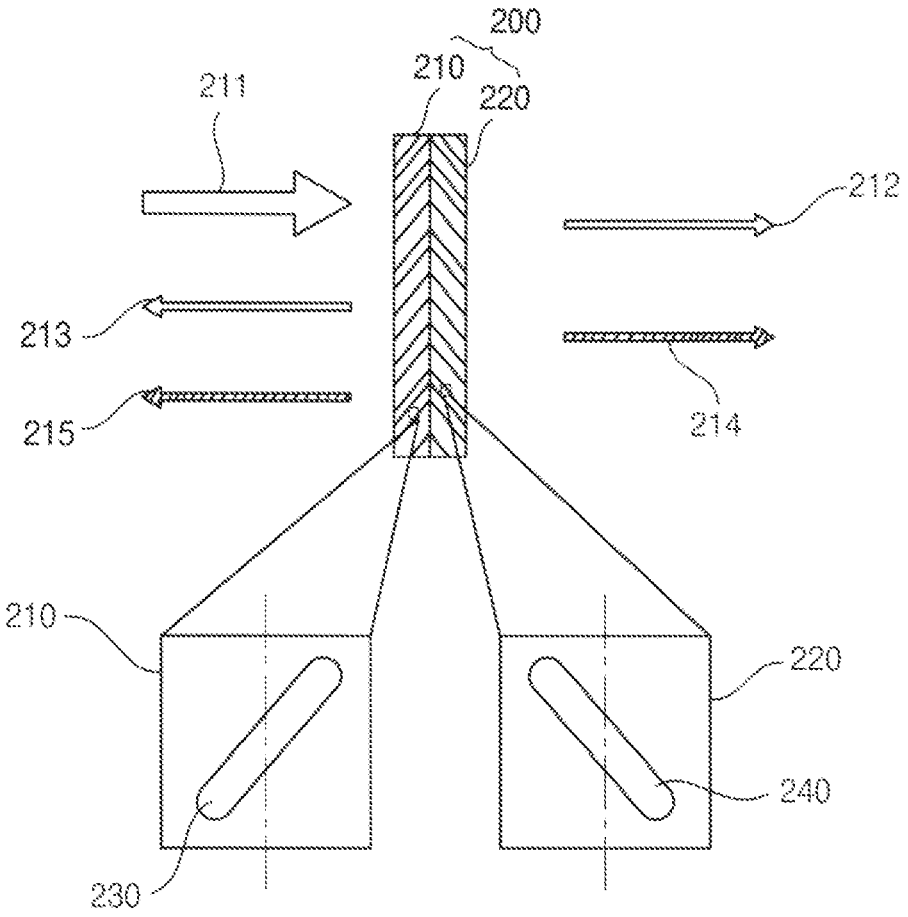
FIG. 13 is a cross-sectional view illustrating a microstructure of a dual layer anisotropic media.

FIG. 13 is a cross-sectional view illustrating a microstructure of a dual layer anisotropic media.

FIG. 13 shows an example of the microstructure of the anisotropic media 200 of the dual layer explained referring to FIG. 6A, and referring to FIG. 13, the dual layer anisotropic media 200 includes first and second media 210 and 220. Each of the first and second media 210 and 220 satisfy all conditions, partial conditions or approximate conditions of the above-mentioned trans-modal Fabry-Pérot resonance.

Thus, the incident elastic wave 211 is transmitted without the mode conversion 212 or with the mode conversion 214, or is reflected without the mode conversion 213 or with the mode conversion 215.

Here, the first and second media 210 and 220 of the anisotropic media 200 of the dual layer may include first and second microstructures 230 and 240 symmetric to each other, respectively, as illustrated in FIG. 13.

The elastic metamaterial may be constructed by the anisotropic media 200 having the first and second microstructures 230 and 240 repeatedly.

In the above example embodiments, the elastic wave is vertically incident into the anisotropic media having a two-dimensional plane shape.

However, the above example embodiments may be applied to the cases that the elastic wave is incident into the anisotropic media having a two-dimensional plane shape with an inclination, and the elastic wave is incident into the anisotropic media having a three-dimensional shape.

In the three-dimensional shape, the shear wave includes a shear horizontal wave and a shear vertical wave that are respectively vibrated horizontally and vertically, and thus, the transmodal resonance between the longitudinal wave and the transverse wave occurs, or the transmodal resonance between the horizontal transverse wave and the vertical transverse wave occurs, according to the mode-coupling coefficient of the anisotropic media.

FIGS. 14A to 14F are cross-sectional views illustrating microstructures of an anisotropic media according still another example embodiments of the present invention.

The microstructures illustrated in FIGS. 14A to 14F are examples of the anisotropic media performing the elastic transmodal resonance. A shape, dimension, phase or numbers of spaces may be variously formed to perform the anisotropic media satisfying the transmodal Fabry-Pérot resonance conditions.

Figure 14A:
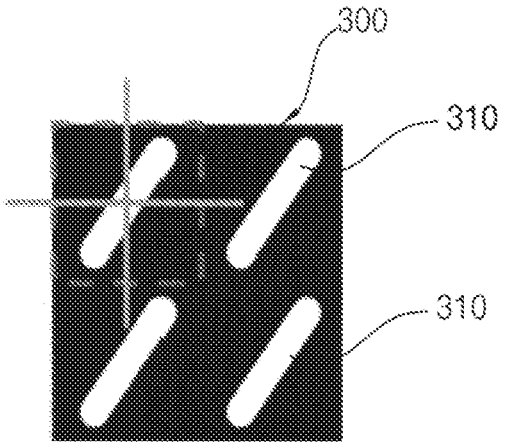
FIGS. 14A to 14F are cross-sectional views illustrating microstructures of the anisotropic media according still another example embodiments of the present invention.

For example, as illustrated in FIG. 14A, a single phase slit 310 having a single interface on which different materials face or a curved slit shape microstructure is repeated, to perform the anisotropic media 300.

Figure 14B:
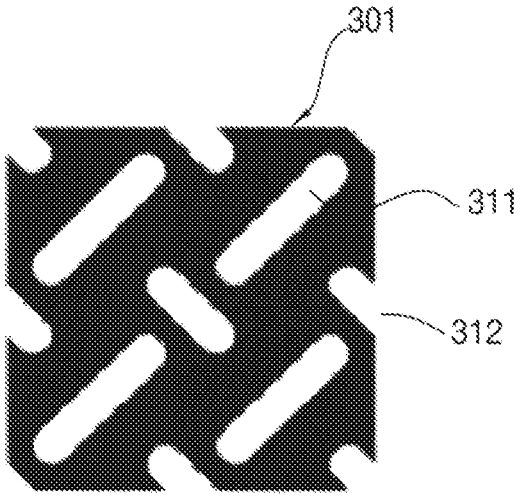

As illustrated in FIG. 14B, a single phase slit 311 and other slit 312 perpendicular to the single phase slit 311 are repeated, to perform the anisotropic media 301. The silt structure of FIG. 14B may generate the almost perfect trans-modal Fabry-Pérot resonance.

Figure 14C:
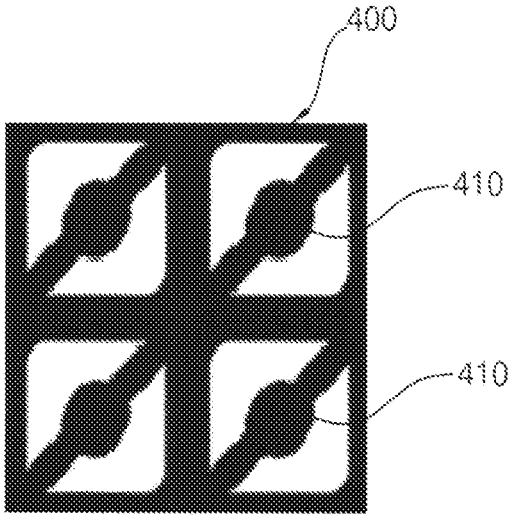
Figure 14D:
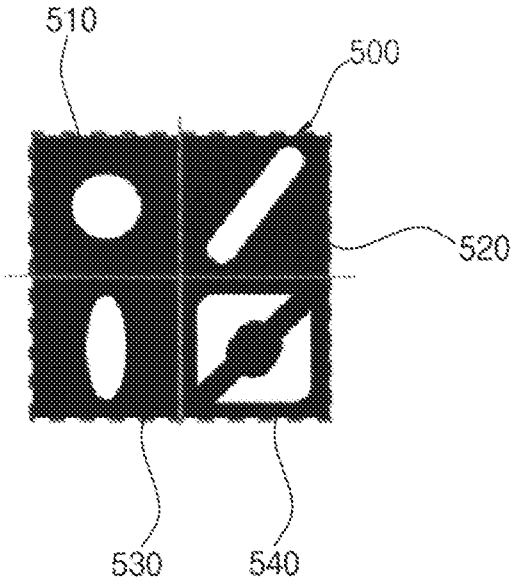

As illustrated in FIG. 14C, a microstructure having inclined shape resonators 410 is repeated, to perform the anisotropic media 400.

In addition, a super cell 500 in which various kinds of microstructures 510, 520, 530 and 540 are complicatedly mixed, may perform the anisotropic media, and here, the size of the super cell 500 is smaller than a wavelength of the incident wave and the super cell 500 has periodicity.

Figure 14E:
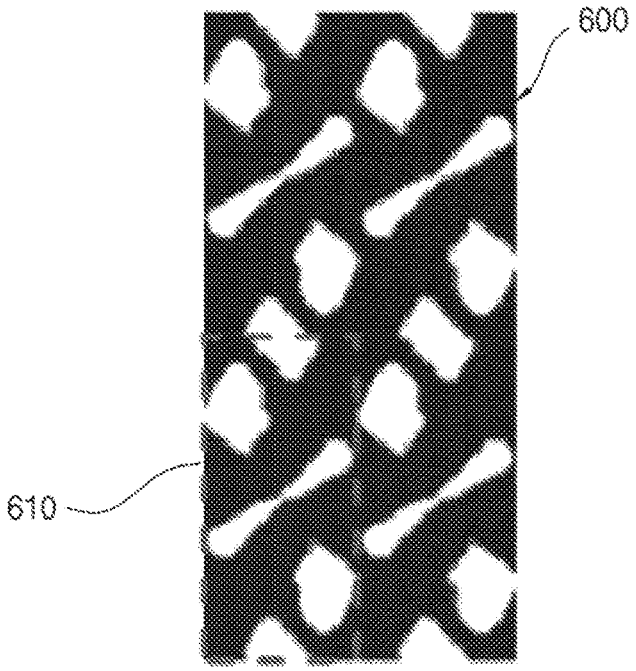
Figure 14F:
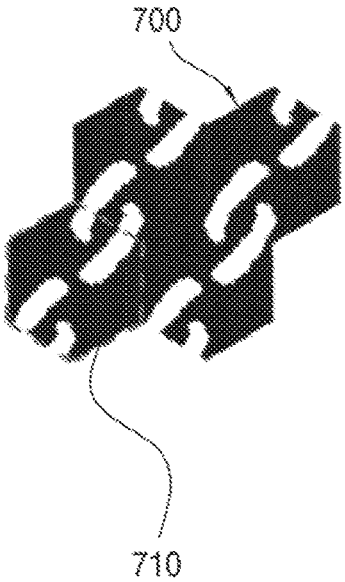

A shape of the unit cell or the super cell, as illustrated in FIGS. 14E and 14F, may be a rectangle 610 or a hexagon 710, and thus perform the anisotropic media 600 and 700 with a constant period.

The microstructure of the anisotropic media may include all kinds of unit cell shape having periodicity such as parallelogram, hexagon and other polygons in addition to square or rectangle.

In addition, the material consisting the microstructure may be solid or fluid.

Figure 15A:
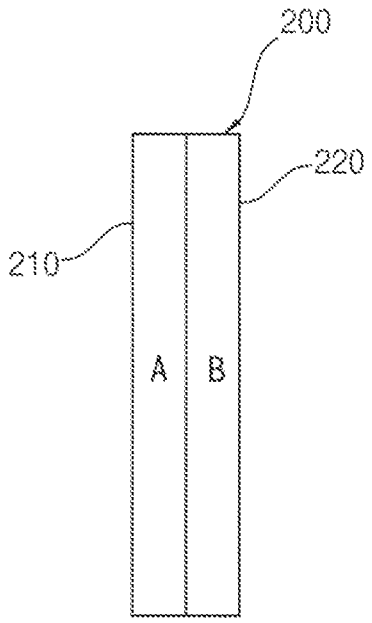
FIGS. 15A to 15C are cross-sectional views illustrating the anisotropic media according to still another example embodiments of the present invention.
Figure 15B:
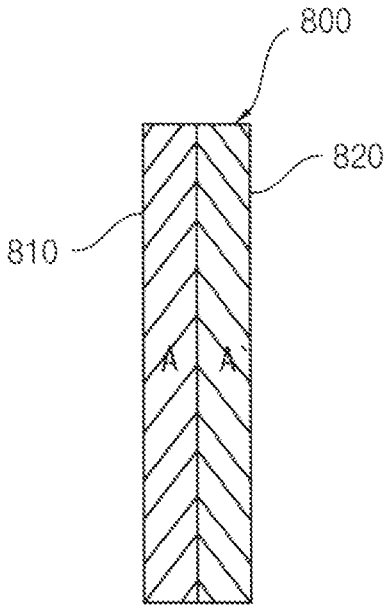
Figure 15C:
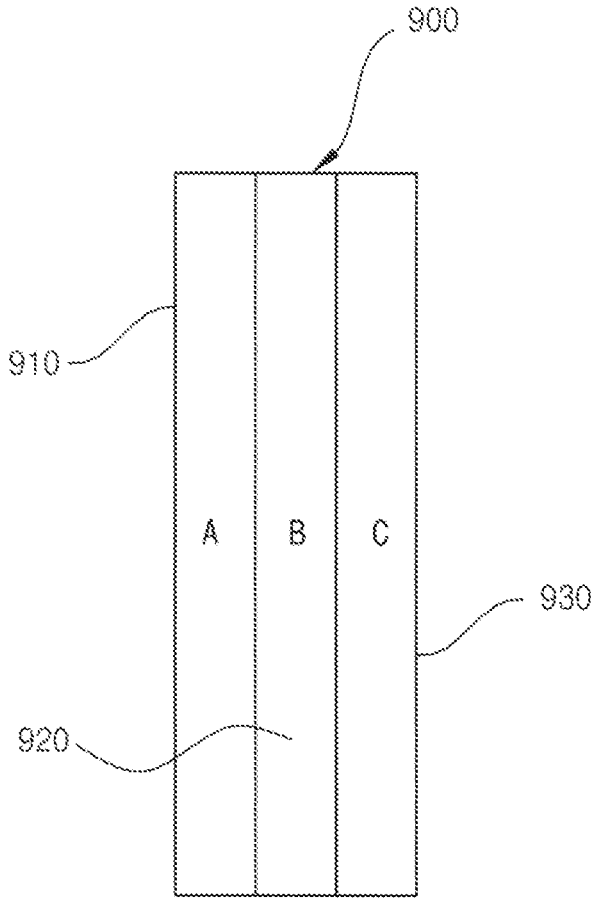

FIGS. 15A to 15C are cross-sectional views illustrating an anisotropic media according to still another example embodiments of the present invention.

Referring to FIG. 15A, the anisotropic media 200 may include two media 210 and 220 continuously arranged and different from each other. Referring to FIG. 15B, two media 810 and 820 continuously arranged and different from each other having symmetric microstructures may perform the anisotropic media 800.

Referring to FIG. 15C, the anisotropic media 900 may include three media 910, 920 and 930 continuously arranged and different from each other.

Although not shown in the figure, each media illustrated in FIGS. 15A to 15C, is repeated with a multilayer, to comprise the anisotropic media.

Accordingly, various kinds of microstructural metamaterials and multilayered structures may compose the anisotropic media to have various kinds of properties, and thus frequency wideband efficient mode conversion, or frequency narrowband efficient mode conversion selective to a certain frequency may be performed.

Hereinafter, a filter for elastic wave mode conversion, an ultrasound transducer using the filter, and a wave energy dissipater using the filter are explained.

Conventionally, when an elastic wave is incident parallel with a principal axis of an isotropic layer or an anisotropic layer, which is a very limited case, a transmissive wave and a reflective wave are generated, since mode coupling between a longitudinal wave and a transverse wave does not occur in the layer. Here, when the Fabry-Pérot resonance occurs in a single mode at the layer without a mode-coupling, the transmissivity in the single mode may be 100%.

Conventionally, a frequency f when the non-transmodal Fabry-Pérot resonance occurs is defined as Equation (14).

$$f = \frac{N}{2d} \cdot \sqrt{\frac{C}{\rho}} \qquad \text{Equation (14)}$$

Here, d is a thickness of the layer, N is a positive number, C is a longitudinal modulus of elasticity or a shear modulus of elasticity, ρ is a mass density.

In the filter for elastic wave mode conversion (trans-mode) (hereinafter called as 'filter') according to the present example embodiment, vertical and horizontal vibrations of the elastic waves are combined inside thereof, and thus, the filter has a mode-coupling stiffness constant not zero. Here, a converted different mode in addition to the wave mode incident into the filter exists as a transmissive wave and a reflective wave. For example, the longitudinal wave exists when the transverse wave is incident, and vice versa.

For convenience of explanation, a single longitudinal wave mode and a single transverse wave mode are considered in a plane, and same mode-decoupled media, for example an isotropic media, are considered to be disposed adjacent to the filter of the present example embodiment. Here, to generate the transmodal Fabry-Pérot resonance, at which the transmodal transmissivity of the elastic wave incident to the filter is maximized, the phase change of each of two eigenmodes existing inside of the filter satisfies integer times of π.

Thus, when a first transmodal Fabry-Pérot resonance is generated in the filter, the phase change of each of two eigenmodes existing inside of the filter ((wave number of eigenmode)*(thickness of filter)) satisfies integer times of π.

Equation (15) may express the above-mentioned case.

$$k_1 \cdot d = N_1 \cdot \pi,$$

$$k_2 \cdot d = N_2 \cdot \pi \qquad \text{Equation (15)}$$

Here, d is a thickness of the filter, $k_1$ is a wave number of eigenmode 1, $k_2$ is a wave number of eigenmode 2, $N_1$ is the number of nodal points of displacement field of a first eigenmode, and $N_2$ is the number of the nodal points of displacement field of a second eigenmode.

More specifically, to generate the transmodal Fabry-Pérot resonance accurately, one of $N_1$ and $N_2$ is even times of π, and the other of $N_1$ and $N_2$ is odd times of π.

Here, a first Fabry-Pérot resonance frequency $f_1$ (hereinafter called as 'resonance frequency') at which the mode conversion (trans-mode) is maximized, is expressed using a material property of the filter and is defined as Equation (16).

$$f_1 = \frac{1}{2d} \cdot \sqrt{\frac{C_L + C_S}{\rho}} \cdot \left(\frac{1}{N_1^2} + \frac{1}{N_2^2}\right)^{-1/2} = \frac{1}{2d} \cdot \sqrt[4]{\frac{C_L C_S - C_{MC}^2}{\rho^2}} \cdot \sqrt{N_1 N_2} \qquad \text{Equation (16)}$$

Here, d is a thickness of filter, $C_L$ is a longitudinal modulus of elasticity of the filter, $C_S$ is a transverse modulus of elasticity of the filter, $C_{MC}$ is a mode coupling modulus of elasticity of the filter, ρ is a mass density of filter, $N_1$ is the number of nodal points of displacement field of a first eigenmode, and $N_2$ is the number of the nodal points of displacement field of a second eigenmode.

In addition, second, third, and further resonance frequency f may be selected as odd times of the first resonance frequency $f_1$ and the mode conversion may be performed.

Equation (17) may express the resonance frequency, for example.

$$f = (2n-1) \cdot f_1 \qquad \text{Equation (17)}$$

Here, n is a positive number, and $f_1$ is a first resonance frequency of the filter.

In addition, Equation (18) may calculate the material property such as ρ, $C_L$, $C_S$, and $C_{MC}$ of the filter having the resonance frequency selected by the user.

$$\frac{C_L + C_S}{\rho} = 4 f_1^2 d^2 \cdot \left(\frac{1}{N_1^2} + \frac{1}{N_2^2}\right), \quad \frac{C_L C_S - C_{MC}^2}{\rho^2} = \left(\frac{4 f_1^2 d^2}{N_1 N_2}\right)^2 \qquad \text{Equation (18)}$$

Further, for ultra-high pure elastic wave mode conversion of the filters in which only elastic wave mode is transmissive at the resonance frequency, the filter has two eigenmodes in which the vibration directions are ±45°, and the filter has the longitudinal modulus of elasticity and shear modulus of elasticity same with each other.

The above additional conditions may be expressed by Equation (19).

$$C_L = C_S \qquad \text{Equation (19)}$$

Here, the material property such as ρ, $C_L$, $C_S$, and $C_{MC}$ of the filter performing the ultra-high pure elastic wave mode conversion may be defined as Equation (20) from equations (18) and (19).

$$\frac{C_L}{\rho} = 2 f_1^2 d^2 \cdot \left(\frac{1}{N_1^2} + \frac{1}{N_2^2}\right), \quad \frac{C_{MC}}{\rho} = \pm 2 f_1^2 d^2 \cdot \left|\frac{1}{N_1^2} - \frac{1}{N_2^2}\right| \qquad \text{Equation (20)}$$

When the material property of the filter is defined, the equation (20) may be defined as Equation (21) calculating the first resonance frequency at which the ultra-high pure elastic wave mode conversion is generated.

$$f_1 = \frac{1}{\sqrt{2}\, d} \cdot \sqrt{\frac{C_L}{\rho}} \cdot \left(\frac{1}{N_1^2} + \frac{1}{N_2^2}\right)^{-1/2} \qquad \text{Equation (21)}$$

-continued $$= \frac{1}{\sqrt{2}\,d} \cdot \sqrt{\frac{|C_{MC}|}{\rho}} \cdot \left|\frac{1}{N_1^2} - \frac{1}{N_2^2}\right|^{-1/2}$$

Here, d is a thickness of filter, $C_L$ is a longitudinal modulus of elasticity of the filter, $C_{MC}$ is a mode coupling modulus of elasticity of the filter, ρ is a mass density of filter, $N_1$ is the number of nodal points of displacement field of a first eigenmode, and $N_2$ is the number of the nodal points of displacement field of a second eigenmode.

In Equations (16) to (21), the longitudinal modulus of elasticity of the filter ($C_L$) and the transverse modulus of elasticity of the filter ($C_S$) may be applied when the longitudinal wave and the transverse wave are mode-converted in a two-dimensional plane. When two modes of the longitudinal wave, the horizontal transverse wave and the vertical transverse wave are converted in a space, the longitudinal modulus of elasticity and the transverse modulus of elasticity are replaced as two of the longitudinal modulus of elasticity of the filter ($C_L$), the horizontal direction shear modulus of elasticity of the filter ($C_{SH}$) and the vertical direction shear modulus of elasticity of the filter ($C_{SV}$), and thus Equations (16) to (21) may express various kinds of transmodal function of the filter.

Furthermore, when three elastic wave eigenmodes are generated and exist inside of the filter for the incident elastic wave in the three-dimensional space, each of at least two eigenmodes has the phase change ((wave number of eigenmode)*(thickness of filter)) satisfying integer times of π, and thus various kinds of the transmodal Fabry-Pérot resonance between the longitudinal wave, the horizontal transverse wave and the vertical transverse wave in the space.

When each of three eigenmodes of the filter has the phase change of integer times of π, the wave numbers of each of three eigenmodes may be expressed as Equation (22).

$$k_1 \cdot d = N_1 \cdot \pi,$$

$$k_2 \cdot d = N_2 \cdot \pi,$$

$$k_3 \cdot d = N_3 \cdot \pi \qquad \text{Equation (22)}$$

Here, d is a thickness of the filter, $k_1$ is a wave number of eigenmode 1, $k_2$ is a wave number of eigenmode 2, $k_3$ is a wave number of eigenmode 3, $N_1$ is the number of nodal points of displacement field of a first eigenmode, $N_2$ is the number of the nodal points of displacement field of a second eigenmode, and $N_3$ is the number of the nodal points of displacement field of a third eigenmode.

In addition, to generate the transmodal Fabry-Pérot resonance accurately, at least one nodal point satisfying even numbers of π, and at least one nodal point satisfying odd numbers of π should exist among the numbers of nodal points of three eigenmodes $N_1$, $N_2$ and $N_3$.

In addition, to maximize the transmodal efficiency between the longitudinal wave, the horizontal transverse wave and the vertical transverse wave, at least two of the longitudinal modulus of elasticity of the filter ($C_L$), the horizontal direction shear modulus of elasticity of the filter ($C_{SH}$) and the vertical direction shear modulus of elasticity of the filter ($C_{SV}$) are same with each other, and at least two of the longitudinal-horizontal direction shear mode-coupling modulus of elasticity of the filter ($C_{L\text{-}SH}$), the longitudinal-vertical direction shear mode-coupling modulus of elasticity of the filter ($C_{L\text{-}SV}$), and the horizontal direction shear-vertical direction shear mode-coupling modulus of elasticity of the filter ($C_{SH\text{-}SV}$) are same with each other.

The outer media adjacent to both sides of the filter may affect the efficiency of mode conversion of the filter and frequency bandwidth. For example, the maximum transmodal efficiency (efficiency of mode conversion) is related to a ratio between a mechanical impedance of the outer media at a first side (for example, a left side) with respect to the mode incident into the first side of the filter, and a mechanical impedance of the outer media at a second side (for example, a right side) with respect to the mode transmissive to and converted by the filter. Here, when above two mechanical impedances are same with each other, the maximum transmodal efficiency may be 100%.

The material properties of the filter in Equations (18) to (20) may be performed by using homogeneous anisotropic material such as a chemically synthesized solid crystal, or performed by heterogeneous anisotropic material having elastic metamaterial or composite material having the microstructure smaller than the wavelength of the elastic wave.

In addition, the filter mentioned above is explained in detail referring the figures. The filter mentioned below satisfies Equations (15) to (21) or (22), and may generate the transmodal Fabry-Pérot resonance.

Figure 16A:
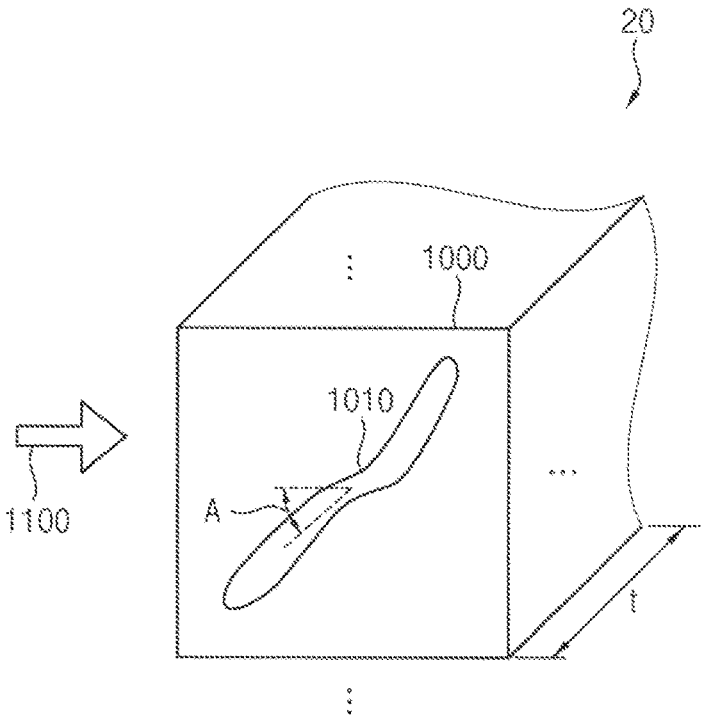
FIG. 16A is a schematic view illustrating a unit pattern of a filter for elastic wave mode conversion in a plane according to still another example embodiment.
Figure 16B:
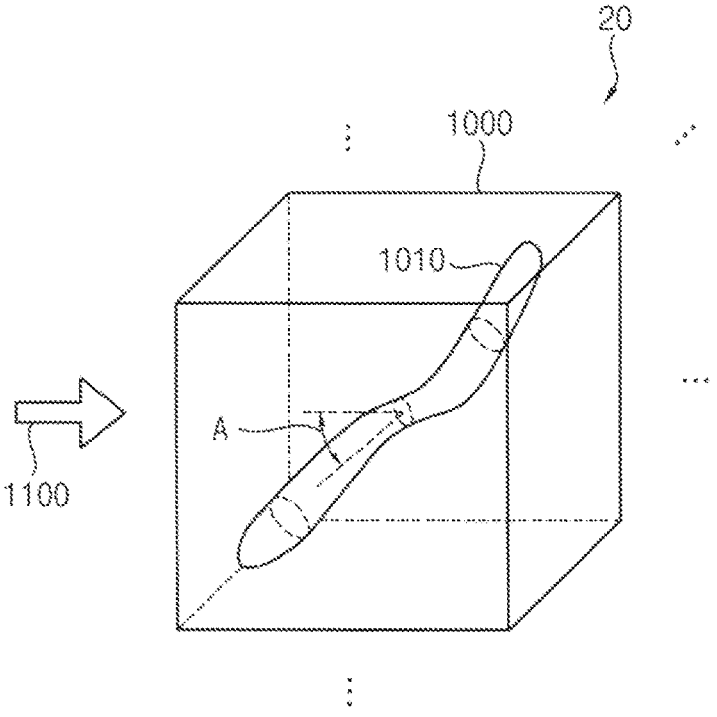
FIG. 16B is a schematic view illustrating a unit pattern of the filter for elastic wave mode conversion of FIG. 16A, in a space.

FIG. 16A is a schematic view illustrating a unit pattern of a filter for elastic wave mode conversion in a plane according to still another example embodiment, and FIG. 16B is a schematic view illustrating a unit pattern of the filter for elastic wave mode conversion of FIG. 16A, in a space.

Referring to FIGS. 16A and 16B, the filter 20 according to the present example embodiment includes the material having the mode-coupling stiffness constants not zero with respect to the incident direction of the elastic wave to generate the transmodal Fabry-Pérot resonance between the longitudinal wave and the transverse wave.

For example, as mentioned above, the filter 20 may include heterogeneous anisotropic material having microstructure patterns thereinside, such as anisotropic material, artificially synthesized homogeneous anisotropic material, metamaterial, and so on.

Here, the filter 20 include at least one microstructure 1010 as a unit pattern in a plane or in a space, which is inclined by a predetermined angle with respect to the incident direction of the elastic wave 1100, or is asymmetric to the incident axis.

The filter includes at least one unit pattern 1000 variously arranged, and at least one unit pattern 1000 includes at least one microstructures 1010 thereinside.

As illustrated in FIGS. 16A and 16B, the unit pattern 1000 as illustrated in the two-dimensional plane or the three-dimensional space, includes the microstructure 1010 extending along an inclined direction by an angle A with respect the incident direction of the elastic wave 1100. In addition, at least one unit pattern 1000 is periodically arranged adjacent to each other, to complete the filter 20.

Here, the unit pattern 1000 may have a shape of square, rectangle, parallelogram, hexagon or other polygons, or may have a shape of cube, rectangle, parallelepiped, hexagon pole or other polyhedron, and may have a thickness t in the space.

Figure 17:
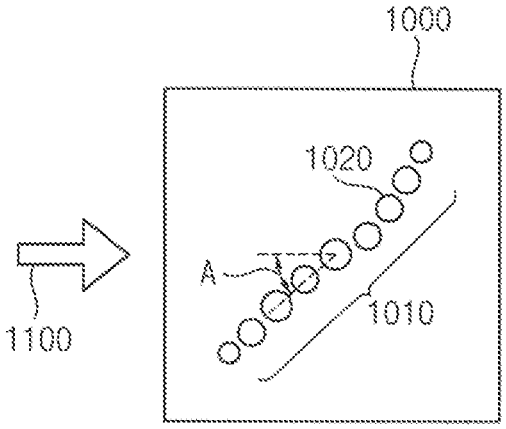
FIG. 17 is a schematic view illustrating a microstructure of the unit pattern of the filter of FIGS. 16A and 16B.

FIG. 17 is a schematic view illustrating a microstructure of the unit pattern of the filter of FIGS. 16A and 16B.

Referring to FIG. 17, the microstructure 1010 includes various shapes of lower microstructures 1020, and each lower microstructure 1020 forms upper microstructures (microstructure 1010).

Here, each lower microstructure 1020 is disposed such that the upper microstructure is inclined with respect to the incident direction of the elastic wave 1100 or is inclined asymmetric to the incident direction of the elastic wave 1100.

For example, as the lower microstructures are arranged as illustrated in FIG. 17, the upper microstructure 1010, which is the microstructure, is inclined by the angle A with respect to the incident direction of the elastic wave 1100, and thus the elastic wave mode-coupling may be caused.

Figure 18:
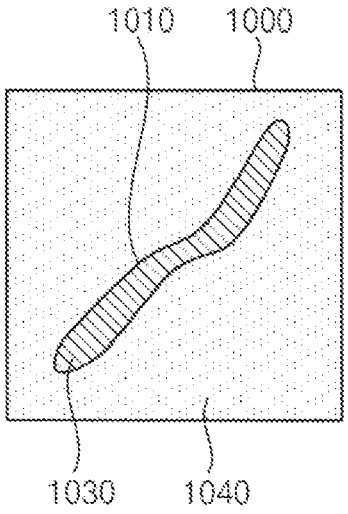
FIG. 18 is a schematic view illustrating the unit pattern of the filter of FIGS. 16A and 16B having the materials different from each other.

FIG. 18 is a schematic view illustrating the unit pattern of the filter of FIGS. 16A and 16B having the materials different from each other.

Referring to FIG. 18, as for the unit pattern 1000 of the filter 20, the inner material 1030 of the microstructure 1010 with respect to the interface of the microstructure 1010, is different from the outer material 1040 of the microstructure 1010.

The microstructure may be formed as various kinds of shapes, when the microstructure is disposed inclined by the angle A with respect to the incident elastic wave 1100, and hereinafter, the various kinds of shapes of the microstructure will be explained.

Figure 19A:
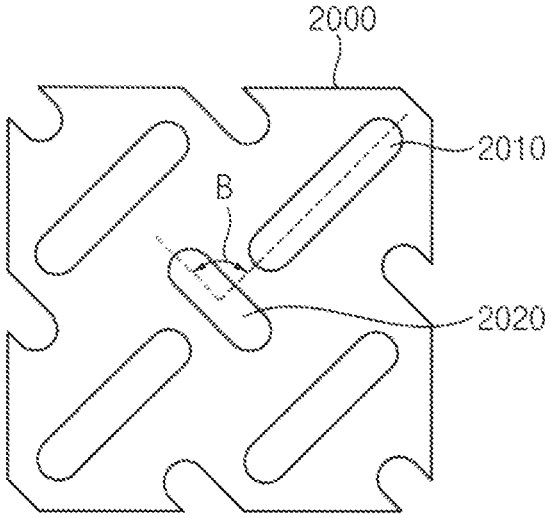
FIGS. 19A and 19B are schematic views illustrating a unit pattern of a filter for elastic wave mode conversion according to still another example embodiment of the present invention.
Figure 19B:
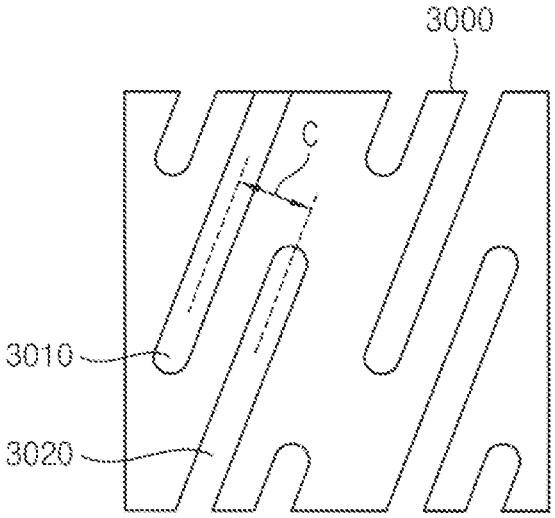

FIGS. 19A and 19B are schematic views illustrating a unit pattern of a filter for elastic wave mode conversion according to still another example embodiment of the present invention.

The unit pattern of the filter 20 may include various kinds of microstructures, and referring to FIG. 19A, as for the unit pattern 2000 of the filter according to the present example embodiment, relatively longer microstructure 2010 and relatively shorter microstructure 2020 are repeatedly arranged in perpendicular or with an inclination of angle B.

Alternatively, as illustrated in FIG. 19B, for the unit pattern 3000 of the filter, two microstructures 3010 and 3020 having the length same with each other are repeatedly arranged in parallel with a distance C.

Figure 20A:
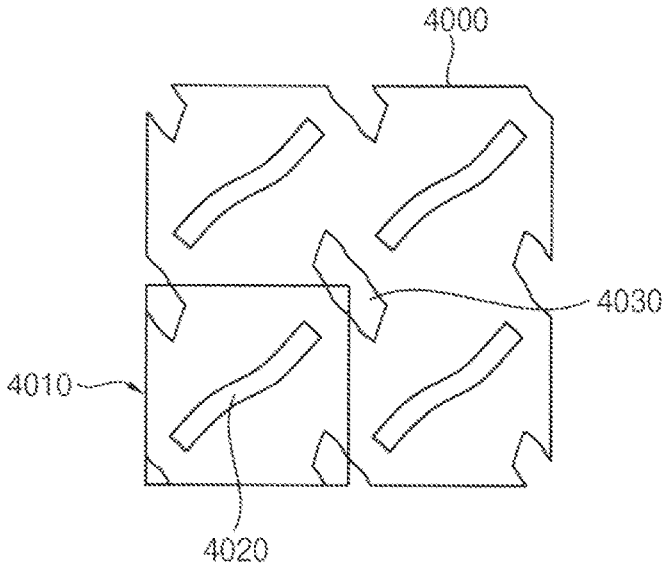
FIGS. 20A, 20B and 20C are schematic views illustrating a unit pattern of a filter for elastic wave mode conversion according to still another example embodiment of the present invention.
Figure 20B:
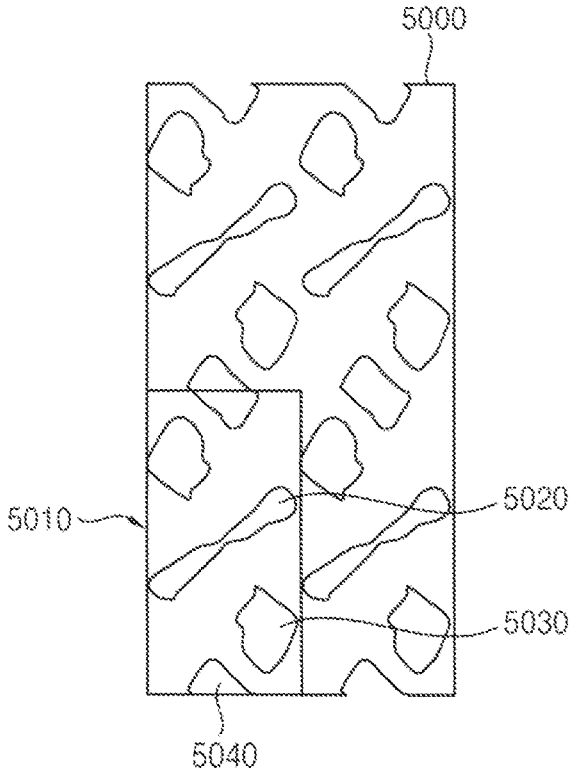
Figure 20C:
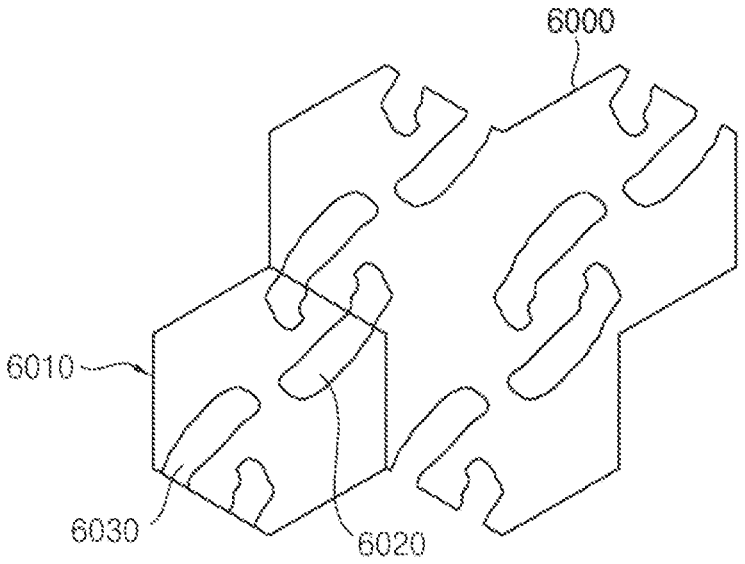

FIGS. 20A, 20B and 20C are schematic views illustrating a unit pattern of a filter for elastic wave mode conversion according to still another example embodiment of the present invention.

Referring to FIG. 20A, the microstructure forming the unit pattern 4000 of the filter includes a unit microstructure 4010 having first and second microstructures 4020 and 4030 repeatedly arranged. The unit pattern 4000 may be a square in the plane and a cube in the space.

Referring to FIG. 20B, the microstructure forming the unit pattern 5000 of the filter may be formed as a unit microstructure 5010 having first to third microstructures 5020, 5030 and 5040 repeatedly arranged. The unit pattern 5000 may be a rectangle in the plane and a rectangular parallelepiped in the space.

Referring to FIG. 20C, the microstructure forming the unit pattern 6000 of the filter may be formed as a unit microstructure 6010 having first and second microstructures 6020 and 6030 repeatedly arranged. The unit pattern 6000 may be a hexagon repeated in the plane.

Further, although not shown in the figure, the shape of the unit pattern of the filter is irregular, and thus may be formed as an amorphous polygons or polyhedron in the plane or in the space.

Figure 21:
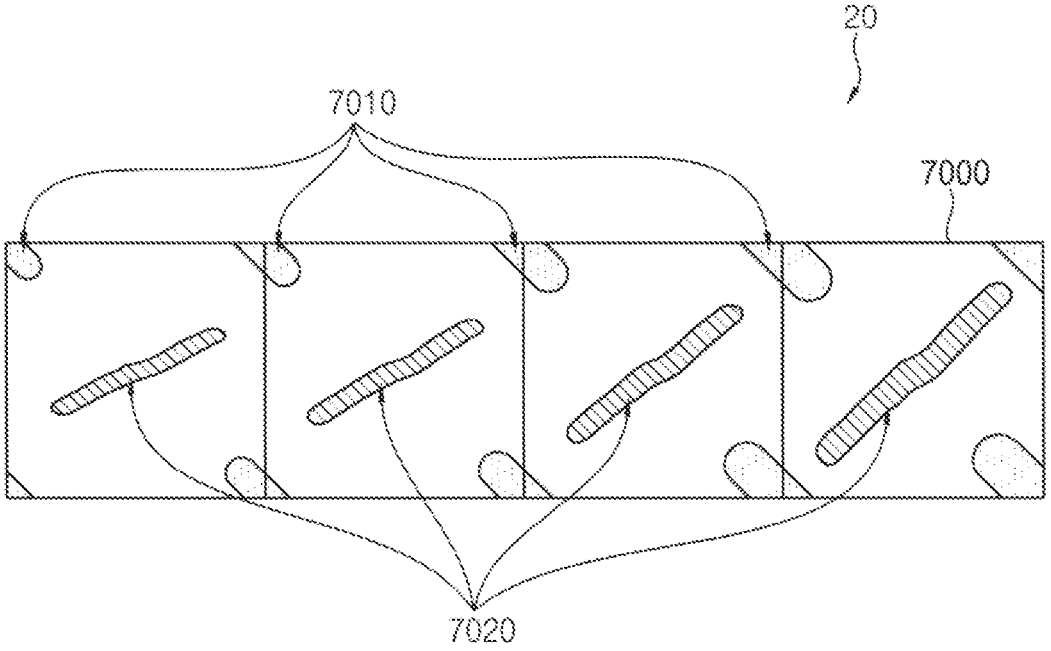
FIG. 21 is a schematic view illustrating a unit patter of a filter for elastic wave mode conversion according to still another example embodiment of the present invention.

FIG. 21 is a schematic view illustrating a unit pattern of a filter for elastic wave mode conversion according to still another example embodiment of the present invention.

Referring to FIG. 21, as for a unit pattern 7000 of the filter 20, the unit pattern is continuously arranged and thus a shape, a size or an orientation of the microstructures inside of the unit pattern 7000 may be gradually changed.

Figure 22A:
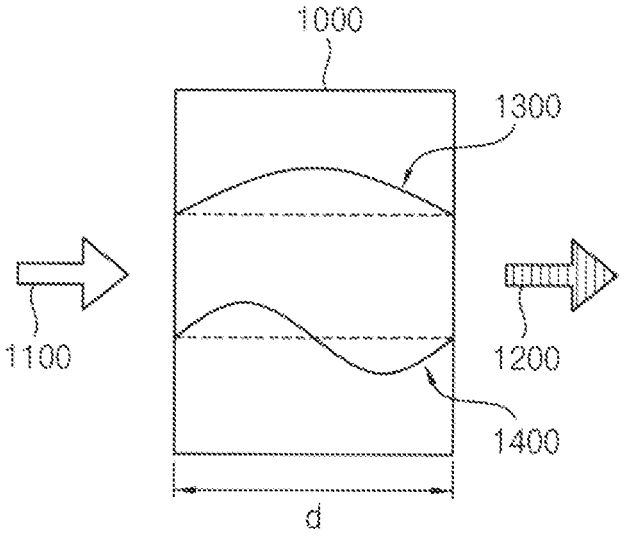
FIG. 22A is a schematic view illustrating the filters of the above-mentioned example embodiments having the maximum mode conversion rate.
Figure 22B:
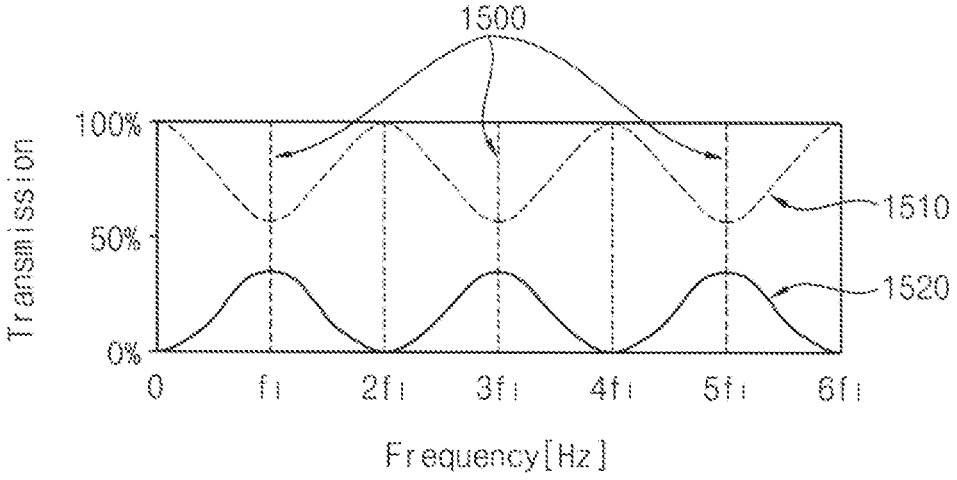
FIG. 22B is a graph showing a performance of the filter according to the operating frequency range.

FIG. 22A is a schematic view illustrating the filters of the above-mentioned example embodiments having the maximum mode conversion rate, and FIG. 22B is a graph showing a performance of the filter according to an operating frequency.

As explained above, for the filter according to the present example embodiment, the eigenmodes of the elastic wave inside of the filter have the phase change satisfying the integer times of half wavelength (or $\pi$).

Thus, FIG. 22A illustrates an example of the unit pattern 1000 of the filter having the maximum transmodal (mode conversion) efficiency for a predetermined frequency of the filter and a predetermined thickness d of the filter under the elastic wave 1100 incidence.

As illustrated in FIG. 22A, the unit pattern 1000 of the filter has an eigenmode 1300 having the phase change of 1 $\pi$ and an eigenmode 1400 having the phase change of 2 $\pi$, and converts the mode of the incident wave 1100 to the transmissive wave 1200 with the maximum efficiency at (frequency)*(thickness). More specifically, for the maximum mode conversion efficiency, at least one wave mode having the phase change of odd times of $\pi$ like the eigenmode 1300 and at least one wave mode having the phase change of even times of $\pi$ like the eigenmode 1400 should exist. Further explanation will be detailed referring to FIG. 23C, and here, in FIG. 22A, the reflective wave of the filter and the transmissive wave without mode conversion are not illustrated.

Thus, as illustrated in FIG. 22B, referring to the mode conversion graph according to an operating frequency of the filter, at the transmodal Fabry-Pérot resonance 1500, the transmissivity 1510 of the incident elastic wave 1100 is minimized and the transmissivity 1520 of the trans-modal elastic wave is maximized.

Here, as explained above, when the longitudinal wave (or the transverse wave) is vertically incident into the filter having the thickness of d in the plane, the transmodal resonance frequency at which the mode conversion into the transverse wave (or the longitudinal wave) is maximized may be selected as the odd times of the frequency in Equation (16).

In addition, as explained above, when the longitudinal wave (or the transverse wave) is vertically incident into the filter having the thickness of d in the plane, the material property of the filter which has the first resonance frequency $f_1$ at which the mode conversion into the transverse wave (or the longitudinal wave) is maximized, and has the longitudinal modulus of elasticity, the shear modulus of elastic and the mode-coupling stiffness constant, may be defined as Equation (18).

Figure 23A:
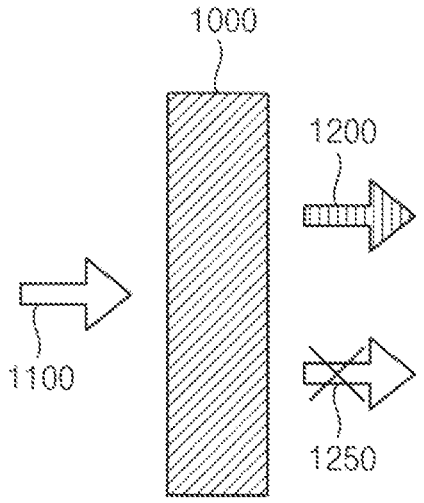
FIG. 23A is a schematic view illustrating ultra-high pure elastic wave mode conversion of the filters of the above-mentioned example embodiments.
Figure 23B:
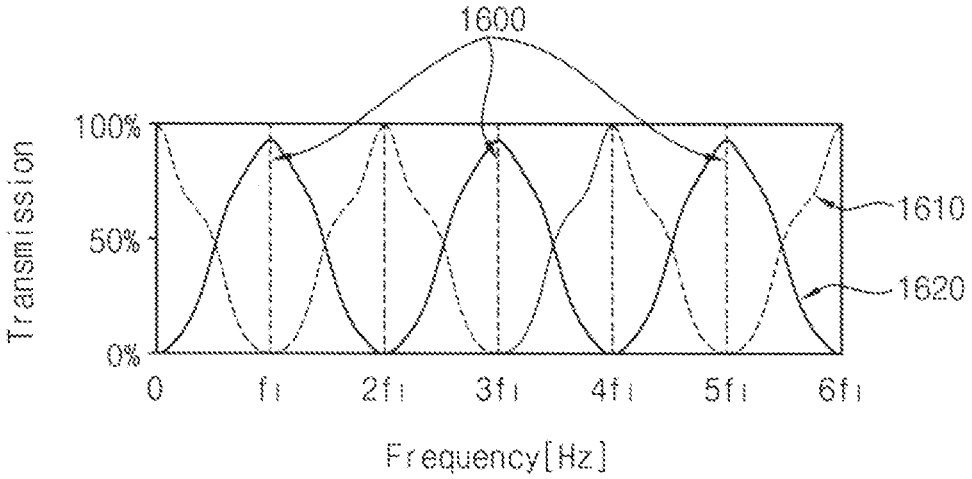
FIG. 23B is a graph showing a performance of the filter according to the operating frequency range.
Figure 23C:
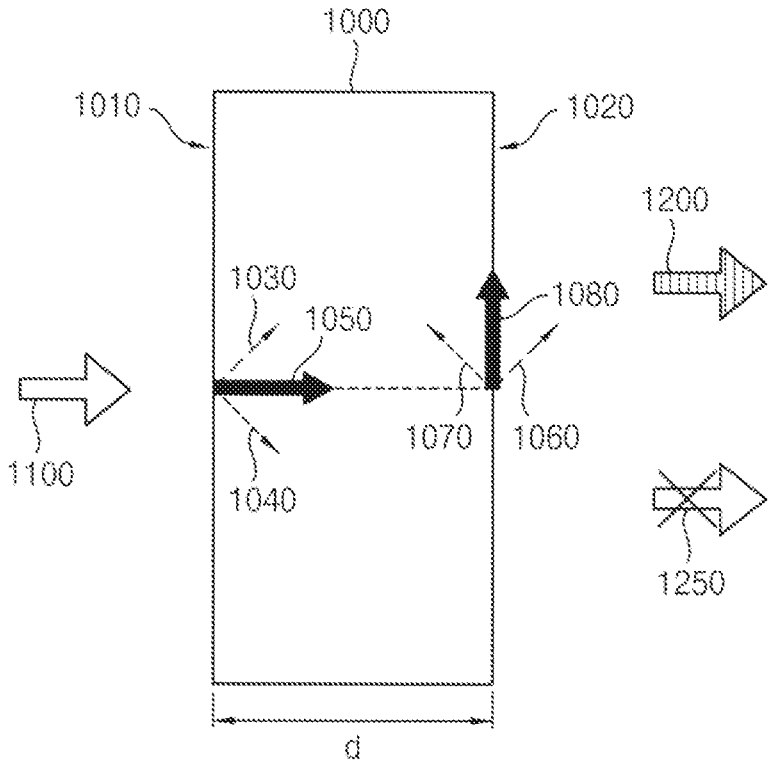
FIG. 23C is a schematic view illustrating operation principle of the filter performing the ultra-high pure elastic wave mode conversion.

FIG. 23A is a schematic view illustrating ultra-high pure elastic wave mode conversion of the filters of the above-mentioned example embodiments, FIG. 23B is a graph showing a performance of the filter according to an operating frequency range, and FIG. 23C is a schematic view illustrating operating principle of the filter performing the ultra-high pure elastic wave mode conversion.

Referring to FIG. 23A, as an example ultra-high pure elastic wave mode conversion of the filter, the longitudinal (or transverse) mode elastic wave 1100 incident into the unit pattern 1000 of the filter is converted to the transverse (or longitudinal) mode elastic wave 1200 and is transmissive, and here the unconverted longitudinal (or transverse) wave mode elastic wave 1250 is not transmissive.

Here, the filter has the shear modulus of elasticity (for example, $C_{44}$, $C_{55}$, $C_{66}$) similar to or same with the longitudinal modulus of elasticity (for example, $C_{11}$, $C_{22}$, $C_{33}$), so that the filter only generates the converted elastic wave mode with ultra-high purity and only transmits the converted elastic wave mode.

Accordingly, referring to FIG. 23B, as an example of the mode conversion according to the operating frequency of the filter in FIG. 23A, at the transmodal Fabry-Pérot resonance 1600, the transmissivity 1610 of the incident elastic wave 1100 is theoretically zero, and the transmissivity 1620 of the mode converted elastic wave is maximized.

In addition, in the above-mentioned ultra-high pure elastic wave mode conversion, when the longitudinal (or transverse) wave is vertically incident into the filter having the thickness of d in the plane, the first resonance frequency $f_1$ at which the ultra-high pure mode conversion to the transverse (or longitudinal) wave is generated may be selected as expressed Equation (21).

Further, when the longitudinal (or transverse) wave is vertically incident into the filter having the thickness of d in the plane, the material properties of the filter having the first resonance frequency $f_1$ at which the ultra-high pure mode conversion to the transverse (or longitudinal) wave is generated may be selected as expressed Equation (20).

Here, referring to FIG. 23C, as an example of the operation theory of the filter performing the ultra-high pure mode conversion, a displacement field 1030 of the eigenmode having the vibration direction of +45° and a displacement field 1040 of the eigenmode having the vibration direction of −45° are generated substantially same with each other with respect to the incident longitudinal wave 1100 having the resonance frequency, at an input part 1010 of the filter 1000. Thus, a net displacement 1050 is generated in parallel with the longitudinal wave 1100. At an output part 1020 of the filter 1000, a first eigenmode having the phase change of even times of π has the displacement field 1060 of the output part having the phase same with the displacement field 1030 of the input part, but a second eigenmode having the phase change of odd times of π has the displacement field 1070 of the output part having the phase opposite to the displacement field 1040 of the input part. Thus, the filter 1000 forms the net displacement 1080 perpendicular to the incident longitudinal wave 1100 at the output part 1020, to block the transmission of the longitudinal wave 1250 and only to transmit the transverse wave 1200.

The operation theory of the above-mentioned conversion, may be explained substantially similar to the conversion from the transverse wave to the longitudinal wave, or the conversion between the transverse waves using the filter, or the mode conversion using the filter having more than two eigenmodes.

Figure 24:
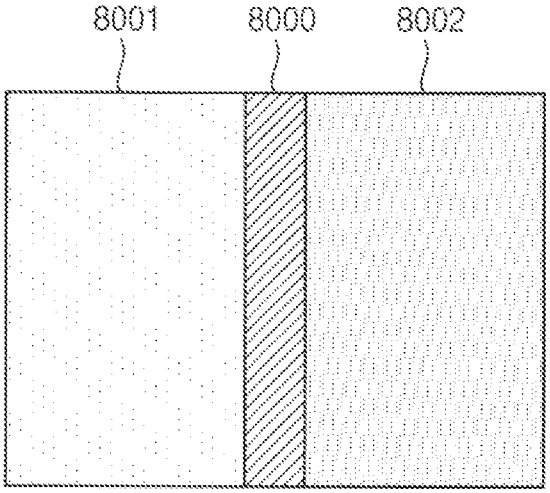
FIG. 24 is a schematic view illustrating the filters of the above-mentioned example embodiments inserted between outer media.

FIG. 24 is a schematic view illustrating the filters of the above-mentioned example embodiments inserted between outer media.

In the present example embodiment, at least one outer media adjacent to the filter may be isotropic solid material, anisotropic solid material, and isotropic and anisotropic fluid (gas or liquid) material.

Hereinafter, for the convenience of explanation, one unit pattern of the filter forms the filter.

Referring to FIG. 24, the filter 8000 is disposed between first outer media 8001 having an incident wave at a first side (for example, the left side) of the filter, and second outer media 8002 having a transmissive wave at a second side (for example, the right side) of the filter. Thus, the maximum transmodal efficiency of the filter may be changed according to the ratio between an impedance of the first outer media 8001 with respect to the incident wave and an impedance of the second outer media 8002 with respect to the mode conversion transmissive wave.

Here, the first and second outer media 8001 and 8002 may be same with each other or different from each other.

Figure 25A:
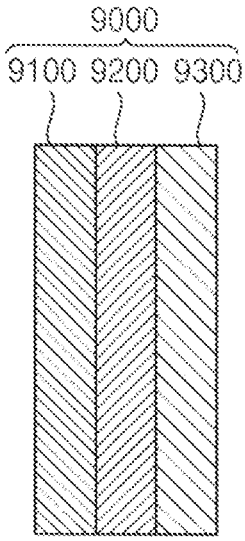
FIG. 25A is a schematic view illustrating a multi filter having the filters of the above-mentioned example embodiments.
Figure 25B:
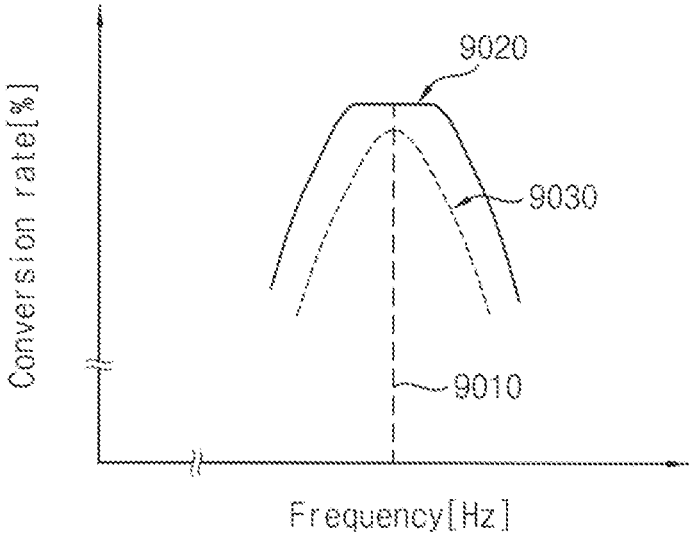
FIG. 25B is a graph showing frequency response of the mode conversion of the multi filter of FIG. 25A.

FIG. 25A is a schematic view illustrating a multi filter having the filters of the above-mentioned example embodiments, and FIG. 25B is a graph showing frequency response of the mode conversion of the multi filter of FIG. 25A.

The filter 9000 may include a multiple filters 9100, 9200 and 9300. Here, each of the filters 9100, 9200 and 9300 includes one unit pattern, for the convenience of explanation, but alternatively, each of the filters 9100, 9200 and 9300 may include a plurality of unit patterns.

When the filter 9000 includes the plurality of filters 9100, 9200 and 9300, the transmodal efficiency (mode conversion efficiency) and the bandwidth of the resonance frequency may be increased.

As for the frequency response of the mode conversion efficiency of the filter 9000, as illustrated in FIG. 25B, the frequency response 9020 of the filter 9000 has the increased mode conversion efficiency and the enlarged bandwidth compared to the frequency response 9030 of each of the filters.

The elastic wave incident into the filter according to the present example embodiment, may be vertically incident into the filter, or be incident into the filter with an inclination.

In addition, in the space, the filter converts the incident longitudinal wave into the shear horizontal wave or the shear vertical wave, and here, the filter controls the amplitude ratio and phase difference between the mode converted shear horizontal wave and the mode converted shear vertical wave, to generate various kinds of transverse elastic waves with linear polarization, circular polarization or elliptical polarization.

Figure 26A:
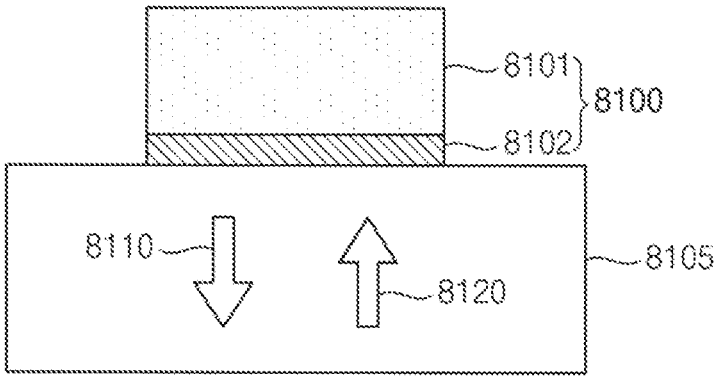
FIG. 26A is a schematic view illustrating an example ultrasound transducer using the filter of the above-mentioned example embodiments.
Figure 26B:
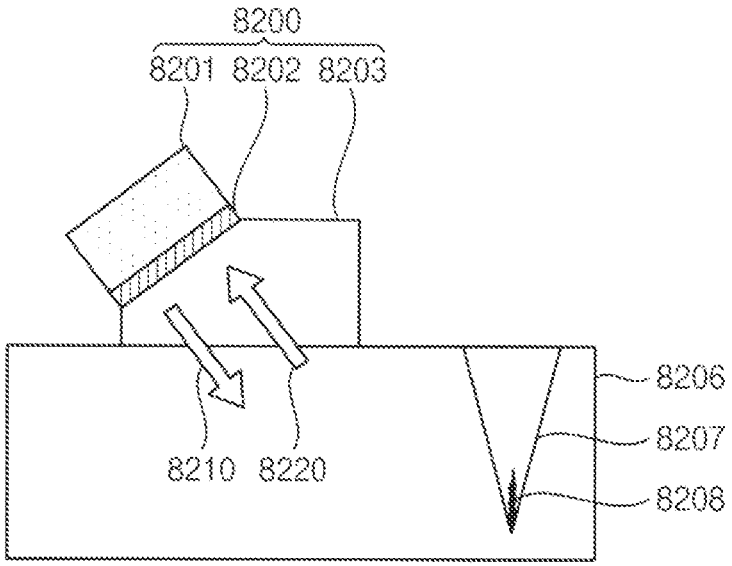
FIG. 26B is a schematic view illustrating another example ultrasound transducer using the filter of the above-mentioned example embodiments.

FIG. 26A is a schematic view illustrating an example ultrasound transducer using the filter of the above-mentioned example embodiments, and FIG. 26B is a schematic view illustrating another example ultrasound transducer using the filter of the above-mentioned example embodiments.

Referring to FIG. 26A, the ultrasound transducer 8100 according to the present example embodiment includes the filter 8102 according to the previous example embodiments and the ultrasound generator 8101.

Thus, the ultrasound transducer 8100 generates the shear wave 8110 perpendicular to the specimen 8105 and transmits the shear wave 8110 to the specimen 8105. Then, the ultrasound transducer 8100 converts the shear wave 8120 returned from the specimen 8105 to the longitudinal wave, and measures the longitudinal wave with high efficiency.

Referring to FIG. 26B, the ultrasound transducer 8200 according to the present example embodiment includes the filter 8202 according to the previous example embodiments, the ultrasound generator 8201 and a wedge 8203.

Here, the wedge 8203 is disposed between the filter 8202 and the specimen 8206, such that the filter 8202 is inclined with respect to the specimen 8206. Thus, the impedance matching may be enhanced.

In addition, the wedge 8203 is used only for the wave obliquely incident into the specimen 8206, and may have high transmissivity since in the wedge 8203 Snell's critical angle is not used as in the conventional wedge.

Here, the ultrasound transducer 8200 generates the shear wave 8210 to transmit the shear wave 8210 to the specimen 8206, and converts the shear wave 8220 returned from the specimen 8206 to the longitudinal wave. Thus, the longitudinal wave may be measured with high efficiency.

When inspecting whether the defect 8208 exists inside of a weld 8207 of the specimen 8206, the ultrasound transducer 8200 according to the present example embodiment may measure the longitudinal wave converted from the returned shear wave 8220, and thus may be used very efficiently.

Although not shown in the figure, the filter 8202 is integrally formed with the wedge 8203 with the same materials, and thus may perform the mode conversion with high transmissivity.

Figure 27:
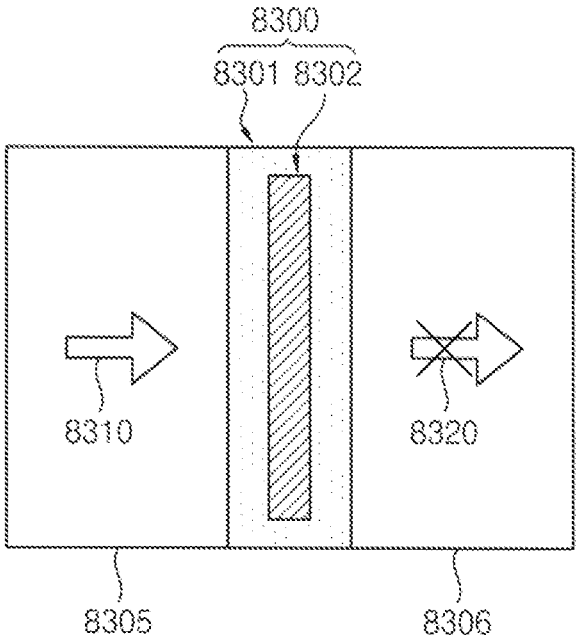
FIG. 27 is a schematic view illustrating an insulation apparatus having a conventional insulation material to which the filters of the above-mentioned example embodiments are inserted.

FIG. 27 is a schematic view illustrating an insulation apparatus having a conventional insulation material to which the filters of the above-mentioned example embodiments are inserted.

Referring to FIG. 27, the highly efficient insulation apparatus 8300 includes the filter 8302 according to the previous example embodiments, and an insulating material 8301 covering the filter 8302.

Here, the filter 8302 is disposed inside of the insulating material 8301, or is combined with the insulating material 8301.

Thus, the sound wave 8310 incident from the outer media 8305 is converted into the transverse elastic wave, and thus the sound wave 8320 transmitted to the next outer media 8306 may be decreased efficiently.

Figure 28A:
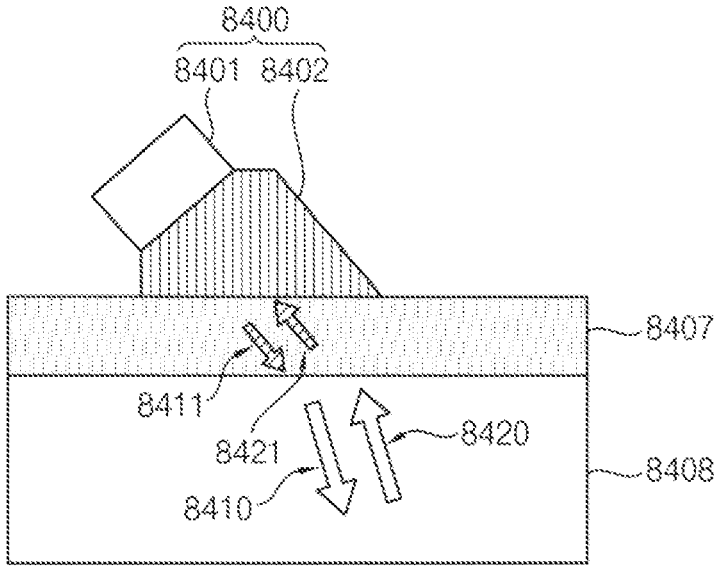
FIG. 28A is a schematic view illustrating a medical ultrasound transducer having the ultrasound incident with inclination.
Figure 28B:
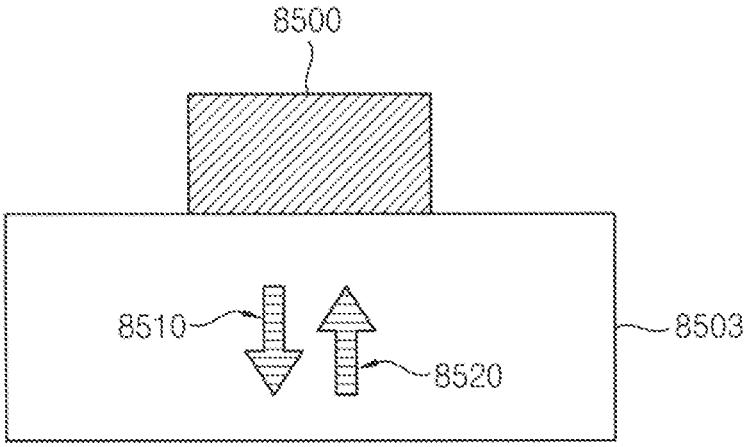
FIG. 28B is a medical ultrasound transducer having the ultrasound incident in perpendicular.

FIG. 28A is a schematic view illustrating a medical ultrasound transducer having the ultrasound incident with inclination, and FIG. 28B is a medical ultrasound transducer having the ultrasound incident in perpendicular.

Referring to FIG. 28A, the medical ultrasound transducer 8400 includes the ultrasound generator 8401 and the wedge 8402 in which the filter according to the previous example embodiments is disposed.

Here, in the medical ultrasound transducer 8400, the shear wave is incident into human tissue with high efficiency, and thus the medical ultrasound transducer 8400 may be used for ultrasound inspection and treatment such as transcranial ultrasonography, blood brain barrier opening, elastography, bone mineral densitometer, tachometry, and so on.

The medical ultrasound transducer 8400 transmits the generated shear wave 8411 to the hard tissue 8407, or measures the returned shear wave 8421. The generated shear wave 8411 transmits the elastic wave or acoustic wave 8410 to the inner fluid media or the soft tissue 8408 with high efficiency. In addition, the elastic wave or acoustic wave 8420 returned from the inner tissue 8408 is converted into the shear wave 8421 to be measured by the medical ultrasound transducer 8400.

In addition, the medical ultrasound transducer 8400 is attached on an outer surface of a pipe in which the fluid flows, and measures the velocity of the fluid inside of the pipe more sensitively and more accurately.

Referring to FIG. 28B, the medical ultrasound transducer 8500 includes the filter inside, such that the ultrasound is vertically incident. Thus, the medical ultrasound transducer 8500 transmits the shear wave 8510 to the human tissue 8503 like the hard tissue or the soft tissue, or measures the returned shear wave 8520.

Figure 29:
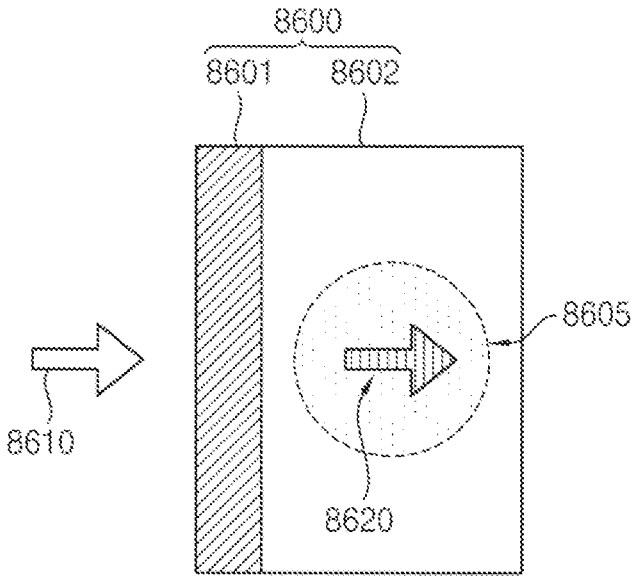
FIG. 29 is a schematic view illustrating a wave energy dissipater based on a shear mode using the filters of the above-mentioned example embodiments.

FIG. 29 is a schematic view illustrating a wave energy dissipater based on a shear mode using the filters of the above-mentioned example embodiments.

Referring to FIG. 29, the wave energy dissipater 8600 based on the shear mode, includes viscoelastic material or dissipating material 8602, and the filter 8601 according to the previous example embodiment.

Here, the viscoelastic material includes the human soft tissue or the rubber, and the dissipating material includes ultrasound backing materials.

Thus, the longitudinal wave 8610 incident into the wave energy dissipater 8600 is converted to the transverse wave 8620, to be transmitted to the dissipating material 8602, and then is dissipated. Here, the heat 8605 generated with dissipating the transverse wave 8620 may be used for the ultrasound treatment.

According to the present example embodiments, an elastic wave mode may be converted very efficiently, using the anisotropic media and the filter satisfying the condition in which the transmodal Fabry-Pérot resonance occurs.

Here, the anisotropic media and the filter may be fabricated by various kinds of structures and materials, and thus the elastic wave mode conversion may be performed variously and various kinds and combination of the wave modes may be performed considering the needs of fields.

In addition, the ultrasound transducer and the wave energy dissipater are performed using the filter, and thus the elastic wave mode may be converted, the transverse wave which is not easy to be excited conventionally may be excited more easily via the effective mode conversion, and the wave energy may be dissipated more efficiently using the mode conversion.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. An anisotropic media for elastic wave mode conversion, the anisotropic media having an anisotropic layer, being disposed between outer isotropic media, causing multiple mode transmission on an elastic wave having a predetermined mode incident into the anisotropic media, and having a mode-coupling stiffness constant not zero, wherein a thickness of the anisotropic layer according to modulus of elasticity and excitation frequency satisfies Equation (2) which is a phase matching condition of elastic waves propagating along the same direction or Equation (3) which is a phase matching condition of elastic waves propagating along the opposite direction, to generate mode conversion Fabry-Pérot resonance, $$\Delta\phi = k_{ql}d - k_{qs}d = (2n+1)\pi, \quad \text{Equation (2)}$$

$$\Sigma\phi = k_{ql}d + k_{qs}d = (2m+1)\pi, \quad \text{Equation (3)}$$

wherein $k_{ql}$; wave numbers of anisotropic media with quasi-longitudinal mode, $k_{qs}$ is wave numbers of anisotropic media with quasi-shear mode, d is a thickness of anisotropic media, n is an integer, and m is an integer.

2. The anisotropic media of claim 1, wherein modulus of elasticity of the anisotropic media satisfies Equation (4), when the anisotropic media satisfies Equations (2) and (3), wherein transmissivity frequency response and reflectivity frequency response is symmetric with respect to a mode conversion Fabry-Pérot resonance frequency, on the incident elastic wave, such that the resonance frequency in which maximum mode conversion is generated between a longitudinal wave and a transverse wave as in Equation (5) is predicted or selected, $$C_{11} + C_{66} = 4\rho f_{TFPR}^2 d^2 \cdot \left(\frac{1}{(m+n+1)^2} + \frac{1}{(m-n)^2}\right), \quad \text{Equation (4}$$

$$C_{11}C_{66} - C_{16}^2 = \left(\frac{4\rho f_{TFPR}^2 d^2}{(m+n+1)(m-n)}\right)^2,$$

-continued $$f_{TFPR} = \frac{1}{\sqrt{4\rho}\cdot d}\cdot\sqrt{C_{11}+C_{66}}\cdot\left(\frac{1}{(m+n+1)^2}+\frac{1}{(m-n)^2}\right)^{-1/2} = \frac{1}{\sqrt{4\rho}\cdot d}\cdot\sqrt[4]{C_{11}C_{66}-C_{16}^2}\cdot\sqrt{(m+n+1)(m-n)}, \quad \text{Equation (5}$$

wherein $C_{11}$ is a longitudinal (or compressive) modulus of elasticity, $C_{66}$ is transverse (or shear) modulus of elasticity, $C_{16}$ is a mode coupling modulus of elasticity, ρ is a mass density of anisotropic media, and $f_{TFPR}$ is a mode conversion Fabry-Pérot resonance frequency.

3. The anisotropic media of claim 1, wherein the incident elastic wave satisfies Equation (6) which is a wave polarization matching condition, $$C_{11}=C_{66} \quad \text{Equation (6)}$$

wherein $C_{11}$ is modulus of longitudinal elasticity of anisotropic media, and $C_{66}$ is modulus of shear elasticity of anisotropic media.

4. The anisotropic media of claim 3, wherein when the anisotropic media satisfies Equation (6), particle vibration direction of quasi-longitudinal wave and quasi-shear wave in an eigenmode is ±45° with respect to a horizontal direction, modulus of elasticity satisfies Equation (7), and perfect mode conversion resonance frequency in which the incident longitudinal (or transverse) wave is perfectly converted into the transverse (or longitudinal) wave to be transmitted satisfies Equation (8), $$C_{11} = C_{66} = 2\rho f_{TFPR}^2 d^2\cdot\left(\frac{1}{(m+n+1)^2}+\frac{1}{(m-n)^2}\right), \quad C_{16} = \pm 2\rho f_{TFPR}^2 d^2\cdot\left|\frac{1}{(m+n+1)^2}-\frac{1}{(m-n)^2}\right|. \quad \text{Equation (7)}$$

$$f_{TFPR} = \frac{1}{\sqrt{2\rho}\cdot d}\cdot\sqrt{C_{11}}\cdot\left(\frac{1}{(m+n+1)^2}+\frac{1}{(m-n)^2}\right)^{-1/2} = \frac{1}{\sqrt{2\rho}\cdot d}\cdot\sqrt{|C_{16}|}\cdot\left|\frac{1}{(m+n+1)^2}-\frac{1}{(m-n)^2}\right|^{-1/2}, \quad \text{Equation (8)}$$

5. The anisotropic media of claim 1, wherein the anisotropic media comprises first and second media symmetric with each other, wherein the first and second media satisfy Equation (9)

$$C_{11}^{1st}=C_{11}^{2nd},\ C_{66}^{1st}=C_{66}^{2nd},\ C_{16}^{1st}=-C_{16}^{2nd},\ \rho_{1st}=\rho_{2nd} \quad \text{Equation (9)}$$

wherein $C_{11}^{1st}$, $C_{66}^{1st}$, $C_{16}^{1st}$ are modulus of longitudinal elasticity, modulus of shear elasticity and mode coupling modulus of elasticity of the first media, are modulus $C_{11}^{2nd}$, $C_{66}^{2nd}$, $C_{16}^{2nd}$ modulus of shear elasticity and $\rho_{1st}$, $\rho_{2nd}$ modulus of elasticity of the second media, and are mass density of the first and second media.

6. The anisotropic media of claim 1, wherein the anisotropic media is formed as a slit in which an interface facing adjacent material is a single to be a single phase, or is formed as a repetitive microstructure having a curved or dented slit shape.

7. The anisotropic media of claim 1, wherein the anisotropic media is formed as at least one unit cell shape of square, rectangle, parallelogram, hexagon and other polygons, having a microstructure and being periodically arranged.

8. The anisotropic media of claim 1, wherein the anisotropic media is formed as a repetitive microstructure having at least two materials different from each other.

9. A filter for elastic wave mode conversion, the filter being disposed between isotropic media, the filter comprising homogeneous anisotropic media or heterogeneous anisotropic media, wherein the heterogeneous anisotropic media has elastic metamaterials or composite materials, wherein the homogeneous anisotropic media or the heterogeneous anisotropic media has a mode-coupling stiffness constant not zero on an incident elastic wave having a predetermined mode, wherein the filter causes multiple mode transmission, and each of at least two elastic wave eigenmodes satisfies a phase change with integer times of half of the wavelength of the phase (or π), so that the mode conversion Fabry-Pérot resonance is generated between the longitudinal wave and the transverse wave or between the longitudinal waves different from each other.

10. The filter of claim 9, wherein the filter has two elastic wave eigenmodes satisfying the phase change with integer times of π ((wave number of eigenmode)*(thickness of filter)) on the incident elastic wave, when two elastic wave eigenmodes are generated and exist inside of the filter, such that the mode conversion Fabry-Pérot resonance is generated between the longitudinal wave and the transverse wave or between the longitudinal waves different from each other.

11. The filter of claim 10, wherein a first mode conversion Fabry-Pérot resonance frequency $f_1$ in which maximum mode conversion is generated, satisfies Equation (18), $$\frac{C_L+C_S}{\rho} = 4f_1^2 d^2\cdot\left(\frac{1}{N_1^2}+\frac{1}{N_2^2}\right), \quad \frac{C_L C_S - C_{MC}^2}{\rho^2} = \left(\frac{4f_1^2 d^2}{N_1 N_2}\right)^2 \quad \text{Equation (18)}$$

wherein $C_L$ is a longitudinal modulus of elasticity of the filter, $C_S$ is a transverse modulus of elasticity of the filter, $C_{MC}$ is a mode coupling modulus of elasticity of the filter, ρ is a mass density of filter, d is a thickness of filter, $N_1$ is the number of nodal points of displacement field of a first eigenmode, and $N_2$ is the number of the nodal points of displacement field of a second eigenmode.

12. The filter of claim 9, wherein second and more mode conversion Fabry-Pérot resonance frequency in which maximum mode conversion is generated, is odd times of a first mode conversion Fabry-Pérot resonance frequency.

13. The filter of claim 12, wherein the filter has a longitudinal modulus of elasticity substantially same as a transverse modulus of elasticity, to perform ultra-high pure elastic wave mode conversion in which a converted elastic wave mode is only transmitted at a resonance frequency.

14. The filter of claim 13, wherein a first mode conversion Fabry-Pérot resonance frequency $f_1$ in which the ultra-high pure elastic wave mode is generated, satisfies Equation (21), $$f_1 = \frac{1}{\sqrt{2}\,d}\cdot\sqrt{\frac{C_L}{\rho}}\cdot\left(\frac{1}{N_1^2}+\frac{1}{N_2^2}\right)^{-1/2} \quad \text{Equation (21)}$$

-continued $$= \frac{1}{\sqrt{2}\,d} \cdot \sqrt{\frac{|C_{MC}|}{\rho}} \cdot \left| \frac{1}{N_1^2} - \frac{1}{N_2^2} \right|^{-1/2}$$

wherein $C_L$ is a longitudinal modulus of elasticity of the filter, $C_S$ is a transverse modulus of elasticity of the filter, $C_{MC}$ is a mode coupling modulus of elasticity of the filter, ρ is a mass density of filter, d is a thickness of filter, $N_1$ is the number of nodal points of displacement field of a first eigenmode, and $N_2$ is the number of the nodal points of displacement field of a second eigenmode.

15. The filter of claim 9, wherein the elastic metamaterial comprises at least one microstructure which is smaller than a wavelength of the elastic wave, and is inclined with respect to an incident direction of the elastic wave or is asymmetric to an incident axis of the elastic wave.

16. The filter of claim 15, wherein the microstructure comprises inner media different from the outer media with respect to an interface of the microstructure.

17. The filter of claim 15, wherein at least one unit cell shape of square, rectangle, parallelogram, hexagon and other polygons is periodically arranged in a plane to form the microstructure, and at least one unit cell shape of cube, rectangle, parallelepiped, hexagon pole and other polyhedron is periodically arranged in a space to form the microstructure.

18. The filter of claim 9, wherein the filter has at least two elastic wave eigenmodes satisfying the phase change with integer times of π ((wave number of eigenmode)*(thickness of filter)) on the incident elastic wave, when three elastic wave eigenmodes are generated and exist inside of the filter, such that the various kinds of the mode conversion Fabry-Pérot resonance is generated among a longitudinal wave, a horizontal transverse wave and a vertical transverse wave.

19. The filter of claim 18, wherein to maximize mode conversion efficiency among the longitudinal wave, the horizontal transverse wave and the vertical transverse wave, at least two of a longitudinal modulus of elasticity of the filter $C_L$, a horizontal direction shear modulus of elasticity of the filter $C_{SH}$, and a vertical direction shear modulus of elasticity of the filter $C_{SV}$, are substantially same with each other, and at least two of a longitudinal-horizontal direction shear mode-coupling modulus of elasticity of the filter $C_{L\text{-}SH}$, a longitudinal-vertical direction shear mode-coupling modulus of elasticity of the filter $C_{L\text{-}SV}$, and horizontal direction shear-vertical direction shear mode-coupling modulus of elasticity of the filter $C_{SH\text{-}SV}$, are substantially same with each other.

20. The filter of claim 18, wherein an incident longitudinal wave is converted into a vertical transverse wave or a horizontal transverse wave, wherein an amplitude ratio and phase difference of the mode converted horizontal transverse wave and vertical transverse wave are controlled to generate one of a linearly polarized transverse elastic wave, a circularly polarized transverse elastic wave and an elliptically polarized transverse elastic wave.

* * * * *